US012188321B2

(12) United States Patent
Campbell

(10) Patent No.: US 12,188,321 B2
(45) **Date of Patent: *Jan. 7, 2025**

(54) MODIFIED TORQUE GENERATOR AND METHODS OF USE

(71) Applicant: CT Energy Ltd., Calgary (CA)

(72) Inventor: Josh Campbell, Calgary (CA)

(73) Assignee: CT Energy Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/365,784

(22) Filed: Aug. 4, 2023

(65) Prior Publication Data

US 2024/0068314 A1 Feb. 29, 2024

Related U.S. Application Data

(62) Division of application No. 17/429,265, filed as application No. PCT/CA2020/051060 on Jul. 31, 2020, now Pat. No. 11,982,147.

(60) Provisional application No. 62/880,717, filed on Jul. 31, 2019.

(51) Int. Cl.

| | |
|---|---|
| ***E21B 4/02*** | (2006.01) |
| ***E21B 7/04*** | (2006.01) |
| ***E21B 31/00*** | (2006.01) |

(52) U.S. Cl.

CPC ..... *E21B 31/035* (2020.05); *E21B 4/02* (2013.01); *E21B 7/04* (2013.01)

(58) Field of Classification Search

None

See application file for complete search history.

(56) References Cited

U.S. PATENT DOCUMENTS

| | | | | |
|---|---|---|---|---|
| 8,381,839 | B2 | 2/2013 | Rosenhauch | |
| 11,982,147 | B2 * | 5/2024 | Campbell | E21B 31/035 |
| 2006/0243493 | A1 | 11/2006 | El-Rayes et al. | |

FOREIGN PATENT DOCUMENTS

| | | | |
|---|---|---|---|
| CA | 2995267 | A1 | 9/2018 |
| CN | 104929552 | A | 9/2015 |
| CN | 107476759 | A | 12/2017 |

* cited by examiner

*Primary Examiner* — Giovanna Wright
(74) *Attorney, Agent, or Firm* — Holzer Patel Drennan

(57) ABSTRACT

An apparatus for controlling tool face and methods of use with a torque generator connected to a drill string for drilling linear and nonlinear subterranean bore segments. In some embodiments, the apparatus and methodologies of use comprise a tool controller having an outer housing independently rotatable from and extension conduit extending therethrough and forming an annulus therebetween. The tool controller may provide for a first fluid pathway for allowing a bypass portion of fluids to flow through the torque generator, and a second fluid pathway through the annulus for allowing a torque generator portion of fluids to flow through the annulus. In some embodiments, at least one fluid flow restrictor may be provided within the annulus to controllable cause a cascading reduction in torque generator fluid pressure as it flows through the annulus, allowing high resolution tool face control over a larger (and tunable) range of drill string speed (rpm) set points.

13 Claims, 20 Drawing Sheets

BD = Drill Bit Direction of Rotation
RT = Reactive Torque generated by Drill Bit Rotation
CT = Counter Torque generated by Torque Generator
DTF = Drill Tool Face 372
370
328
338
340
327
334
258
350
330
324
344
342
388b
382
352
354
332
336
390
384
356

MODIFIED TORQUE GENERATOR AND METHODS OF USE

CROSS REFERENCE TO RELATED APPLICATION

The present application claims benefit of priority to and is a divisional application of U.S. patent application Ser. No. 17/429,265 entitled "MODIFIED TORQUE GENERATOR AND METHODS OF USE" and filed Aug. 6, 2021, which is a U.S. National Stage under 35 USC 371 claiming priority to PCT/CA2020/051060 entitled "MODIFIED TORQUE GENERATOR AND METHODS OF USE" and filed Jul. 31, 2020, which claims priority to U.S. Provisional Patent Application 62/880,717 entitled "MODIFIED TORQUE GENERATOR AND METHODS OF USE" and filed Jul. 31, 2019, all of which are specifically incorporated by reference herein for all that they disclose or teach.

FIELD

Embodiments herein are related in general to method and apparatus for directional drilling and more particularly to apparatus utilizing a bottom-hole assembly coupled with a torque device for controlling linear and nonlinear drilled segments of a borehole.

BACKGROUND

Directional drilling is well known in the art and commonly practiced. Directional drilling is generally practiced using a bottom-hole assembly connected to a drill string that is rotated at the surface using a rotary table or a top drive unit, each of which is well known in the art. The bottom-hole assembly includes a positive displacement drilling motor, turbine motor, or a pump that drives a drill bit via a "bent" housing that has at least one axial offset of around 1 to 3 degrees. A measurement-while-drilling (MWD) tool connected to the top of the drilling motor (sometimes also referred to herein as a "mud motor") provides "tool face" information to tracking equipment on the surface to dynamically determine an orientation of a subterranean bore being drilled. The drill string is rigidly connected to the bottom-hole assembly, and rotation of the drill string rotates the bottom-hole assembly.

To drill a linear bore segment, the drill string is rotated at a predetermined speed while drilling mud is pumped down the drill string and through the drilling motor to rotate the drill bit. The drill bit is therefore rotated simultaneously by the drilling motor and the drill string to drill a substantially linear bore segment. When a nonlinear bore segment is desired, the rotation of the drill string is stopped and controlled rotation of the rotary table or the top drive unit and/or controlled use of reactive torque generated by downward pressure referred to as "weight on bit" is used to orient the tool face in a desired direction. Drill mud is then pumped through the drill string to drive the drill bit, while the weight of the drill string supported by the drill rig is reduced to slide the drill string forward into the bore as the bore progresses. The drill string is not rotated while directional drilling is in progress.

However, this method of directional drilling has certain disadvantages. For example: during directional drilling the sliding drill string has a tendency to "stick-slip", especially in bores that include more than one nonlinear bore segment or in bores with a long horizontal bore segment; when the drill string sticks the drill bit may not engage the drill face with enough force to advance the bore, and when the friction is overcome and the drill string slips the drill bit may be forced against the bottom of the bore with enough force to damage the bit, stall the drilling motor, or drastically change the tool face, each of which is quite undesirable; and, rotation of the drill string helps to propel drill cuttings out of the bore, so when the drill string rotation is stopped drill cuttings can accumulate and create an obstruction to the return flow of drill mud, which is essential for the drilling operation. Furthermore, during directional drilling the reactive torque causes the stationary drill string to "wind up", which can also drastically change the tool face.

One solution to slip-slick related issues is set forth in U.S. Pat. No. 8,381,839 to Rosenhauch. Therein, the bottom hole assembly is permitted to rotate independently of the drill string. When the bit is driven clockwise by the mud motor, reactive rotation of the bottom-hole assembly and bent sub is counterclockwise. A torque generator between the drill string and the bottom-hole assembly resists the reactive rotation. Rotation of the drill string at a static drive speed matches the reactive rotation of the bent sub and the net rotation of the bottom-hole assembly is zero so that the drill bit drills the nonlinear bore segment. Drill string rotation greater than the static drive speed results in a net clockwise rotation of the drill bit for drilling the linear bore segment. The torque generator comprises an arrangement of a modified positive displacement motor displacing fluid through a backpressure nozzle. The arrangement of the motor and the nozzles limits the peak torque available.

One concern with current torque generators is that the performance tune of the tool is limited, which limits the peak torque of the tool when the aim is to control the rpm of the tool face (e.g. set the tool face to rotate at a certain rpm). If the performance tune of the tool is altered to take advantage of all the torque in the torque generator then the control of the tool face is limited by reduced resolution. In other words, even slight changes in the rpm of the tool have a magnified effect on the rpm of the tool face, which makes fine tuning of the tool face rpm very difficult. Therefore, there is a need for a torque generator that is configured to provide optimized torque performance while allowing fine tuning of the tool face.

SUMMARY

According to embodiments, apparatus and methods for improved tool face control are provided, the apparatus and methods usable with a torque generator connected to a drill string for drilling linear or nonlinear subterranean bore segments. The torque generator may be configured to have an outer housing independently rotatable from an inner pump and the drill string extending therethrough. In some embodiments, the present apparatus may comprise an outer tubular housing rotationally coupled to the torque generator housing, the outer tubular housing forming an inner housing bore, an extension conduit received within and extending through the inner housing bore, and forming an annulus therebetween, one or more fluid flow distributors positioned in the inner housing bore for directing at least a portion of fluid pumped into the torque generator into the annulus as torque generator fluid flow, and one or more fluid flow restrictions positioned within the annulus, the one or more fluid flow restrictions causing a fluid pressure reduction in the torque generator fluid stream flowing through the annulus. In some embodiments, at its upper end, the extension conduit may be rotationally coupled to the pump and rotatable with the drill string.

In some embodiments, the one or more fluid flow restrictions may comprise a plurality of piston assemblies operative to provide dynamic flow restriction, enabling a high resolution of tool face control over a larger range of drill string rpm set points.

In other embodiments, the one or more fluid flow restrictions may comprise a plurality of fluid flow restrictions (e.g. helical fluid flow pathway) operative to provide a static flow restriction while improving contact surfaces and mitigating packing off.

In some embodiments, the one or more fluid flow restrictions may comprise a plurality of fluid flow restrictions and at least one piston assembly, operatively combining both static and dynamic flow restriction capabilities.

According to embodiments, apparatus and methods for improved tool face control are provided, the apparatus and methods usable with a torque generator connected to a drill string for drilling linear or nonlinear subterranean bore segments. The torque generator may be configured to have an outer housing independently rotatable from an inner pump and the drill string extending therethrough. In some embodiments, the present method may comprise pumping fluids into the torque generator, a first portion of the fluids passing through the torque generator as a bypass fluid flow, providing a fluid flow distributor for directing a second portion of the fluids into an annulus within the torque generator as a torque generator fluid flow, and providing at least one fluid flow restriction in the annulus for increasing fluid pressure of the torque generator fluid flow above the restriction, creating a reduction in fluid pressure of the torque generator fluid flow. In some embodiments, the methods comprise providing static fluid flow restriction, providing dynamic fluid flow restriction, or a combination thereof.

BRIEF DESCRIPTION OF THE DRAWINGS

FIG. 1 is a schematic diagram of a bottom-hole assembly in accordance with one embodiment of the '839 Patent;

FIG. 2 is a schematic diagram of another embodiment of a bottom-hole assembly in accordance with the invention the '839 Patent;

FIG. 3 is a schematic diagram of a reactive torque generator in accordance with one embodiment of the '839 Patent;

FIG. 4 is a vector diagram schematically illustrating movement of a drill tool face when a drill string connected to a bottom-hole assembly of the '839 Patent is not rotated as the drill bit is rotated by a mud motor of the bottom-hole assembly;

FIG. 5 is a vector diagram schematically illustrating drill tool face stability when the drill string connected to the bottom-hole assembly of the '839 Patent is rotated at a static drive speed as the drill bit is rotated by the mud motor of the bottom-hole assembly;

FIG. 6 is a vector diagram schematically illustrating movement of the drill tool face when the drill string is rotated at a drill ahead speed as the drill bit is rotated by the mud motor of the bottom-hole assembly of the '839 Patent;

FIG. 7 is a vector diagram schematically illustrating movement of the drill tool face when the drill string is rotated at an underdrive speed as the drill bit is rotated by the mud motor of the bottom-hole assembly of the '839 Patent;

FIG. 8 is a flow chart illustrating principal steps of a first method of controlling the bottom-hole assembly shown in FIGS. 1-3 to drill a subterranean bore; and FIG. 9 is a flow chart illustrating principal steps of a second method of controlling the bottom-hole assembly shown in FIGS. 1-3 to drill a subterranean bore.

FIG. 10A is a general arrangement of the BHA having a drilling motor and a torque convertor depicted as a positive displacement motors;

FIG. 10B illustrates the drill string clockwise CW rotation as balanced to or equal to the reverse, counterclockwise CCW reactive rotation of the BHA, the net rotation of the bent sub being neutral or zero for non-linear drilling;

FIG. 10C illustrates the drill string clockwise CW rotation as greater than the reverse, counterclockwise CCW reactive rotation of the BHA, the net rotation of the bent sub being greater than neutral for effecting linear drilling;

FIG. 11A is an overall cross-sectional view of one embodiment of a bottom-hole assembly at a distal end of a rotary drill string; and FIG. 11B is a close up, cross section of the bottom-hole assembly of FIG. 11A.

FIG. 12A is a side perspective view of one embodiment of the alternative lower portion, shown with the outer housing partially omitted to provide a full view of the internal components;

FIG. 12B is a cross-sectional view of the lower portion of FIG. 12A. FIGS. 12A and 12B may be collectively referred to as FIG. 12;

FIGS. 15A, 15B, and 15C may be collectively referred to as FIG. 15.

FIGS. 16A, 16B, and 16C may be collectively referred to as FIG. 16.

FIG. 18A is a side perspective view of another embodiment of the alternative lower portion, shown with the outer housing partially omitted to provide a full view of the internal components;

FIG. 18B is a cross-sectional view of the lower portion of FIG. 18A. FIGS. 18A and 18B may be collectively referred to as FIG. 18;

DETAILED DESCRIPTION OF THE PREFERRED EMBODIMENTS

As set forth in the '839 Patent, the principle of a bottom-hole assembly (BHA) that rotates independently of the drill string, rotatably coupled through a torque generator, is provided for directional drilling of subterranean bore holes. As follows, apparatus and the method of operation according to the '839 patent is first reproduced for establishing the basic principles of directional drilling with a reactive torque generator, and then embodiments of the current apparatus are introduced.

The '839 Patent

In the '839 Patent, the BHA includes a torque generator with a driveshaft at its top end. The driveshaft is connected to a bottom end of a drill string. A housing of the torque generator is connected to a bearing assembly that surrounds the driveshaft and permits the BHA to rotate independently with respect to the drill string and driveshaft. A measurement while drilling (MWD) unit, a bent sub, and a mud motor that turns a drill bit are rigidly connected to a bottom end of the torque generator housing. Rotation of the drill string rotates the driveshaft, which induces the torque generator to generate a torque that counters a reactive torque generated by the mud motor as it turns the drill bit against a bottom of the bore hole. By controlling the rotational speed of the drill string, the bottom-hole assembly can be controlled to drill straight ahead, i.e. a linear bore segment, or directionally at a desired drill tool face, i.e. a non-linear bore segment, to change an azimuth and/or inclination of the bore path. Continuous rotation of the drill string facilitates bore hole cleaning, eliminates slip stick, and improves rate of penetration (ROP) by promoting a consistent weight on the drill bit. The BHA provides a simple all mechanical system for directional drilling that does not require complex and expensive electro-mechanical feedback control systems. The torque generator also acts as a fluid damper in the BHA that provides a means of limiting torque output of the drilling motor such that the damaging effects of stalling the drilling motor may be avoided.

Figure 1:
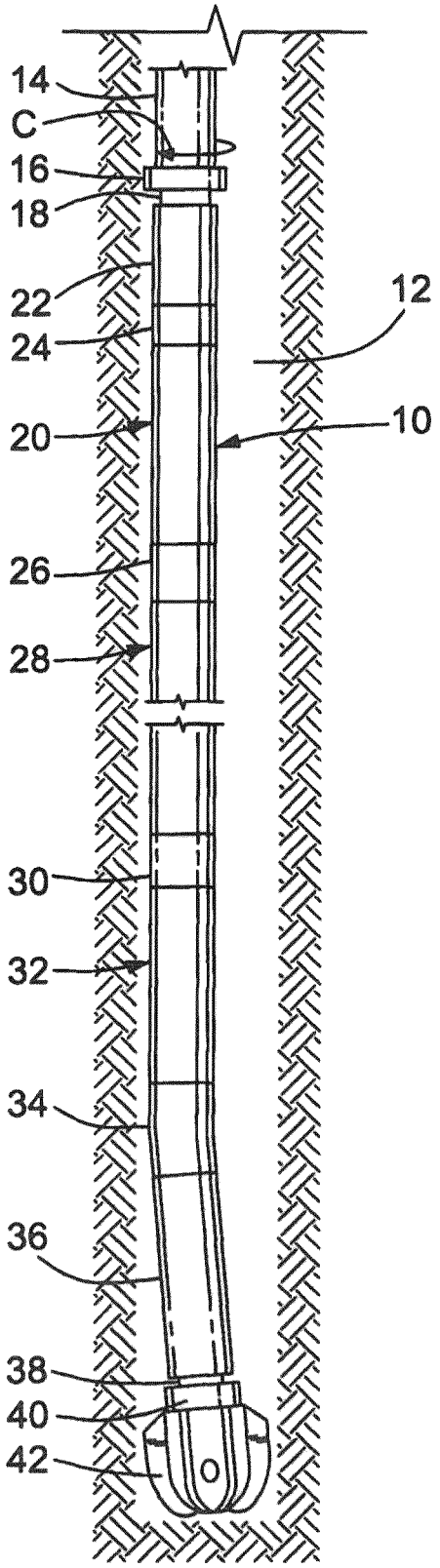
Fig. 1 PRIOR ART
FIGS. 1 through 9 illustrate the prior art method and apparatus set forth in issued U.S. Pat. No. 8,381,839 (the '839 Patent). More particularly.

FIG. 1 is a schematic diagram of a BHA 10 in accordance with one embodiment of the invention, shown in the bottom of a bore hole 12. The BHA 10 is connected to a drill string 14 (only a bottom end of which is shown) by a driveshaft connector 16. In one embodiment the driveshaft connector 16 is similar to a bit-box connection, which is well known in the art. The drill string 14 is rotated in a clockwise direction "C" by a rotary table (not shown) or a top drive unit (not shown), both of which are well known in the art. A driveshaft 18 of a torque generator 20 is rigidly connected to the driveshaft connector 16, so that the driveshaft 18 rotates with the drill string 14. A torque generator bearing section 22 surrounds the driveshaft and supports thrust and radial bearings through which the driveshaft 18 extends. The torque generator bearing section 22 is rigidly connected to a flex coupling housing 24 that is in turn rigidly connected to the torque generator 20, as will be explained below in more detail with reference to FIG. 3. The torque generator 20 may be any positive displacement motor that will generate a torque when the driveshaft 18 is turned by the drill string 14. In one embodiment the torque generator 20 is a modified progressive cavity pump, as will be explained in more detail below with reference to FIG. 3. A mud flow combination sub 26 is rigidly connected to a bottom end of the torque generator 20, as will likewise be explained below in more detail with reference to FIG. 3.

Rigidly connected to the bottom of the mud flow combination sub 26 is a measurement while drilling (MWD) unit 28, many versions of which are well known in the art. The MWD 28 may be capable of providing data only when the MWD 28 is rotationally stationary; in which case it is used to provide drill tool face orientation and take bore hole orientation surveys. Alternatively, the MWD 28 may be capable of providing both azimuth and inclination data while rotating; in which case it can be used to implement an automated drilling control system which will be explained below in more detail. The MWD 28 is rigidly connected to a dump sub 30, which dumps drilling mud from the drill string 14 as required, in a manner well known in the art. Rigidly connected to a bottom of the dump sub 30 is a conventional positive displacement motor (mud motor) 32 that drives a drill bit 42 as drilling mud (not shown) is pumped down the drill string 14 and through the mud motor 32.

Rigidly connected to a bottom end of a power section of the mud motor 32 is a bent housing 34 that facilitates directional drilling by offsetting the drill bit 42 from the axis of the drill string 14. The axial offset in the bent housing 34 is generally about 1.5° to 4°, but the bend shown is exaggerated for the purpose of illustration. The bent housing 34 surrounds a flex coupling (not shown) that connects a rotor of the mud motor 32 to a drill bit driveshaft 38. The drill bit driveshaft 38 is rotatably supported by a bearing section 36 in a manner well known in the art. Connected to a bottom end of the drill bit driveshaft 38 is a bit box 40 that connects the drill bit 42 to the drill bit driveshaft 38. The drill bit 42 may be any suitable earth-boring bit.

Figure 2:
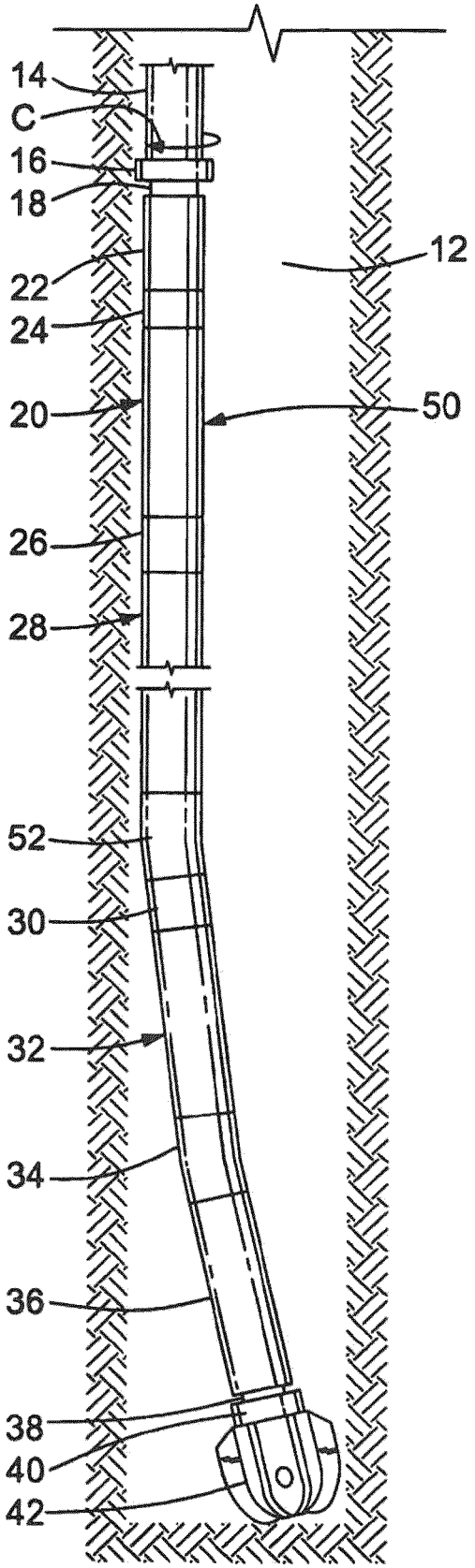
Fig. 2 PRIOR ART

FIG. 2 is a schematic diagram of another embodiment of a BHA 50 in accordance with the invention. The BHA 50 is identical to the BHA 10 described above except that it includes a bent sub 52 between the MWD 28 and the dump sub 30 to provide yet more axial offset for the drill bit 42. The bent sub 52 is useful for boring tight radius curves, which can be useful, for example, to penetrate a narrow hydrocarbon formation.

Figure 3:
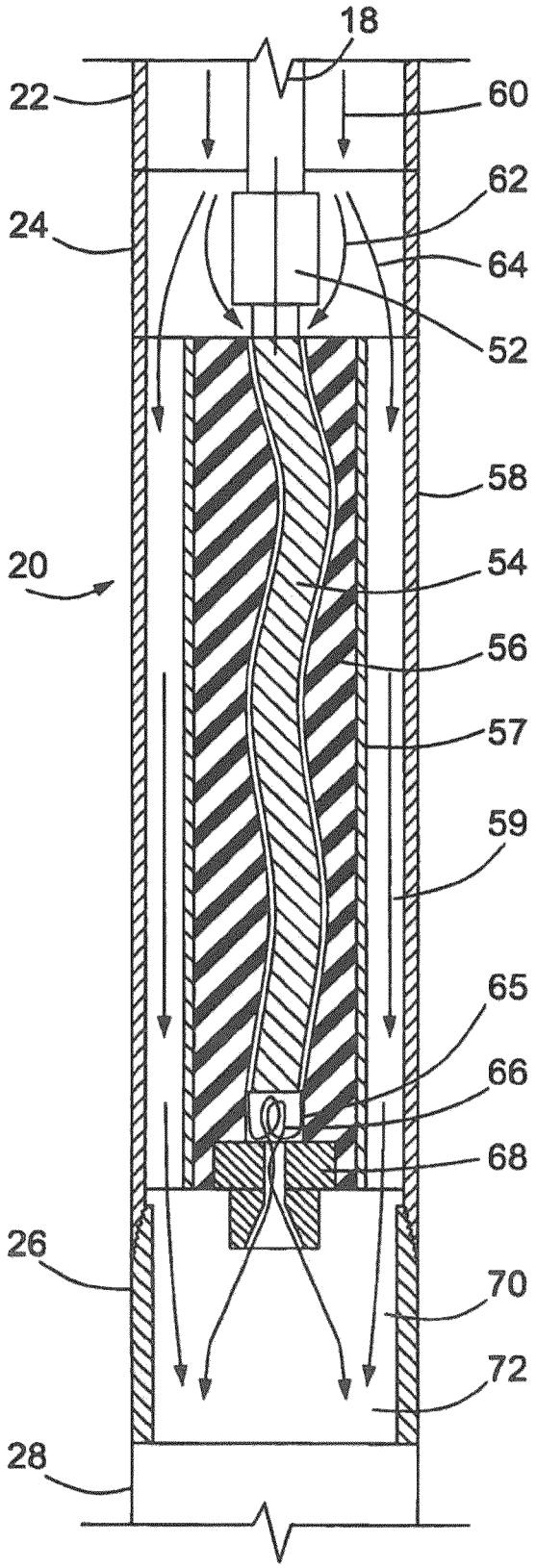
Fig. 3 PRIOR ART

FIG. 3 is a schematic cross-sectional diagram of one embodiment of the torque generator 20 in accordance with the invention. In this embodiment the torque generator 20 is a modified progressive cavity pump, as will be explained below in detail. However, it should be understood that the torque generator 20 may be any modified positive displacement motor (e.g., a gear pump, a vane pump, or the like). It is only important that: a driveshaft of the torque generator 20 can be connected to and driven by the drill string 14 (FIG. 1) and the torque generator 20 outputs a consistent torque when the drill string 14 rotates the driveshaft of the torque generator 20 at a given speed, i.e. at a given number of revolutions per minute (RPM) hereinafter referred to as "static drive speed". It is also important that the torque output by the torque generator 20 be more than adequate to counteract a reactive torque generated by the drill bit 42 when drilling mud is pumped through the mud motor 32 at a predetermined flow rate to rotate the drill bit 42 against a bottom of the bore hole 12 under a nominal weight on bit (WOB).

Thus, the torque generator 20 permits directional drilling while the drill string is rotated at the static drive speed because the BHA 10 is held stationary by the torque generator 20 while the drill bit 42 is rotated by the mud motor 32 to drill a curved path (non-linear bore segment) with a stable drill tool face. This has several distinct advantages. For example: slip stick is eliminated because the rotating drill string 14 is not prone to sticking to the sides of the bore hole; consistent weight-on-bit is achieved because slip stick is eliminated; and, bore hole cleaning is significantly enhanced because the rotating drill string facilitates the ejection of drill cuttings, especially from long horizontal bore runs. If straight ahead (linear bore segment) drilling is desired, the drill string is rotated at a rotational speed other than the static drive speed, which rotates the entire BHA 10, 50 in a way somewhat similar to a conventional directional drilling BHA when it is used for straight ahead drilling.

Furthermore, straight ahead drilling can be accomplished while rotating the drill string 14 at only a marginally lower RPM or a marginally higher RPM (e.g., static drive speed–/+ only 5-10 RPM), because the drill string 14 is always rotated at a high enough RPM to eliminate slip stick and facilitate bore hole cleaning. Consequently, rotation-induced wear and fatigue on the BHA 10 can be minimized. However, it is recommended that straight ahead drilling be accomplished by rotating the drill string 14 at least about +5-10 RPM faster than the static drive speed because the BHA 10, 50 is then rotated clockwise and ROP is improved.

As shown in FIG. 3, the driveshaft 18 of the torque generator 20 is connected by a flex coupling 52 to a progressive cavity pump rotor 54, which is surrounded by a progressive cavity pump stator 56 in a manner known in the art. A casing 57 around the stator 56 is spaced inwardly by stays or spokes (not shown) from the housing 58 of the torque generator 20 to form a torque generator bypass annulus 59 (hereinafter bypass annulus 59). During a drilling operation, drilling mud 60, which is pumped down through the drill string 14 and the BHA 10 to drive the mud motor 32, is split in the flex coupling housing 24 into two separate flows; namely, a torque generator flow 62 that is drawn in by the rotor 54, and a bypass flow 64 that flows through the bypass annulus 59. The torque generator flow 62 is pumped into a compression chamber 65 where it becomes a compressed mud flow 66 that is forced through one or more nozzles 68. The nozzle(s) 68 may be specially designed, or one or more standard bit jet nozzles arranged in series or parallel to control the fluid pressure of the compressed mud flow 66.

The nozzle(s) 68 are selected at the surface before running the BHA 10 into the well. The selection of the nozzle(s) 68 is based on: an anticipated reactive torque generated by the mud motor 32 under a nominal weight-on-bit at an average formation density; a planned static drive speed for the drill string 14 during directional drilling and resulting counter torque generation at the planned static drive speed; and, an anticipated nominal mud density. The static drive speed of the drill string 14 induces the torque generator 20 to generate torque in a direction opposite the reactive torque generated by the mud motor 32 as it turns the drill bit 42 against the bottom of a bore hole. Consequently, the BHA 10 is rotationally stationary at the static drive speed and the drill tool face is stable, which permits directional drilling. Of course, the stability of the drill tool face is influenced by formation hardness, drilling mud density and drill bit design. However, weight-on-bit and/or the rotational speed of the drill string 14 are adjusted as required to compensate for any dynamic variations in drilling conditions to control the stability of the drill tool face during directional drilling.

After exiting the torque generator 20, the drilling mud flows 64 and 66 combine in a mixing chamber 70 of the mud flow combination sub 26 and the combined drilling mud flow 72 is forced down through the BHA 10 to power the mud motor 32 in a manner well known in the art.

Figure 4:
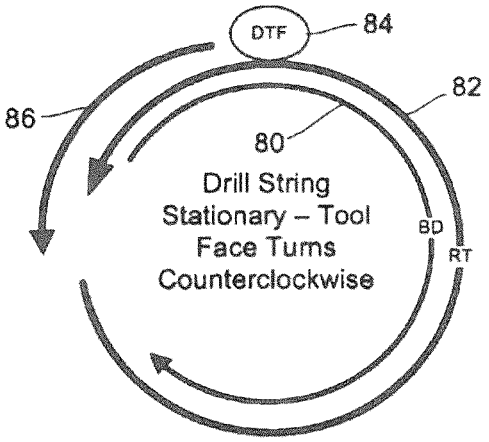
Fig. 4 PRIOR ART

FIG. 4 is a vector diagram schematically illustrating movement of drill tool face 84 if the drill string 14 connected to the BHA 10 is not rotated while the drill bit 42 is rotated by the mud motor 32, which is the mode of operation practiced during directional drilling with a conventional BHA. The mud motor 32 rotates the drill bit 42 in a clockwise direction 80 against a bottom of the well bore 12. The movement of the drill bit 42 generates a reactive torque 82. The reactive torque 82 urges the BHA 10 and the drill tool face 84 to rotate in a counterclockwise direction 86. When the drill string 14 is stationary, there is substantially no resistance to the reactive torque 82 because the driveshaft 18 of the torque generator 20 is not rotating and the torque generator 20 is not generating any counter torque. Consequently, the BHA 10 and the drill tool face 84 rotate counterclockwise as shown at 86. This is not a normal mode of operation for drilling with the BHA 10, and is shown simply to illustrate how the BHA 10 behaves if rotation of the drill string 14 is halted.

Figure 5:
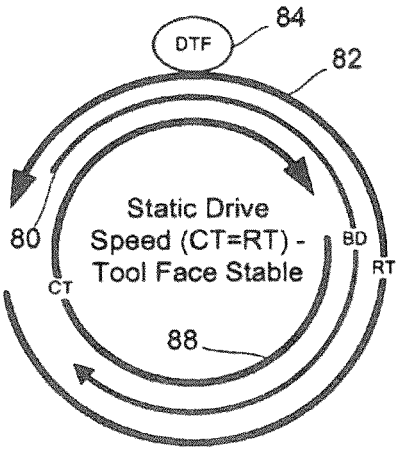
Fig. 5 PRIOR ART

FIG. 5 is a vector diagram schematically illustrating how the drill tool face 84 is stable when the drill string 14 is rotated at the static drive speed while the drill bit 42 is driven by the mud motor 32. At static drive speed a counter torque 88 generated by the torque generator 20 counterbalances the reactive torque 82 generated by the rotation of the drill bit 42. Consequently, the drill tool face 84 is stable and directional drilling is performed. If the formation hardness changes, or any other factor that influences the reactive torque changes, the static drive speed can be easily adjusted at the surface by controlling the rotational speed of the drill string 14 to keep the drill tool face 84 stable for as long as directional drilling is required. As explained above, the static drive speed is principally governed by the selection of the nozzle(s) 68 shown in FIG. 3. The static drive speed can be any convenient RPM within a rotational speed range of the rotary table or the top drive unit. Preferably, the static drive speed is fast enough to eliminate slip stick and promote efficient bore hole cleaning, e.g. around 60 RPM.

Figure 6:
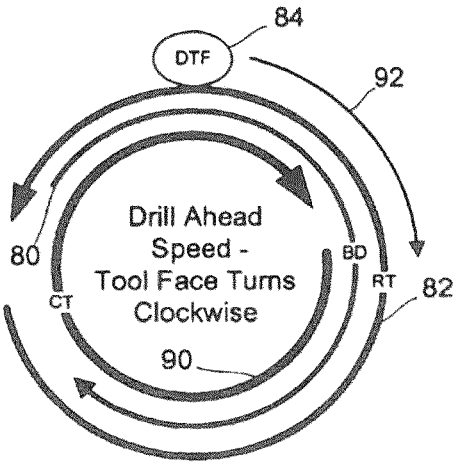
Fig. 6 PRIOR ART

FIG. 6 is a vector diagram schematically illustrating movement of the drill tool face 84 when the drill string 14 is rotated at "drill ahead" speed (e.g. the static drive speed plus at least several RPM). At drill ahead speed, counter torque 90 generated by the torque generator 20 is greater than the reactive torque 82 generated by rotation of the drill bit 42. Since the counter torque is greater than the reactive torque, the BHA 10 and the drill tool face 84 are rotated clockwise. In short applications, drill ahead speed can be used to adjust the drill tool face 84 to set up for directional drilling or to realign the drill tool face 84 during directional drilling. However, drill ahead speed is also used to drill a linear bore segment. Continuous application of drill ahead speed constantly rotates the drill tool face in the clockwise direction, which causes the BHA 10 to drill a linear bore segment from any starting azimuth and inclination. As explained above, the only limits on the drill ahead speed are: a maximum drive speed of the rotary table or the top drive unit; and/or, a manufacturer recommended maximum rotational speed of the BHA 10. Consequently, if the static drive speed is set at about 60 RPM and the BHA 10 is rated for up to about 60 RPM, the drill ahead speed could be as high as 120 RPM, provided the rotary table or the top drive unit is capable of rotating the drill string 14 at that rotational speed. It has been observed that bore hole cleaning is significantly improved by drill string rotational speeds of at least about 90 RPM.

Figure 7:
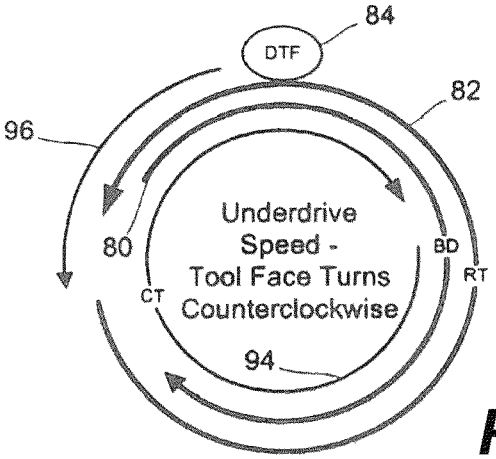
Fig. 7 PRIOR ART

FIG. 7 is a vector diagram schematically illustrating movement of the drill tool face 84 when the drill string 14 is rotated at an "underdrive" speed (e.g. the static drive speed minus at least several RPM). The underdrive speed can be optionally used for straight ahead drilling. Generally, the underdrive speed is only used in short applications to adjust the drill tool face 84 to set up for directional drilling or to realign the drill tool face 84 during directional drilling. When the drill string 14 is rotated at underdrive speed, the counter torque 94 is less than the reactive torque 82. Consequently, the BHA 10 and the drill tool face 84 are rotated in a counterclockwise direction by the reactive torque 82, opposite the direction of rotation of the drill string 14 and the drill bit 42.

Figure 8:
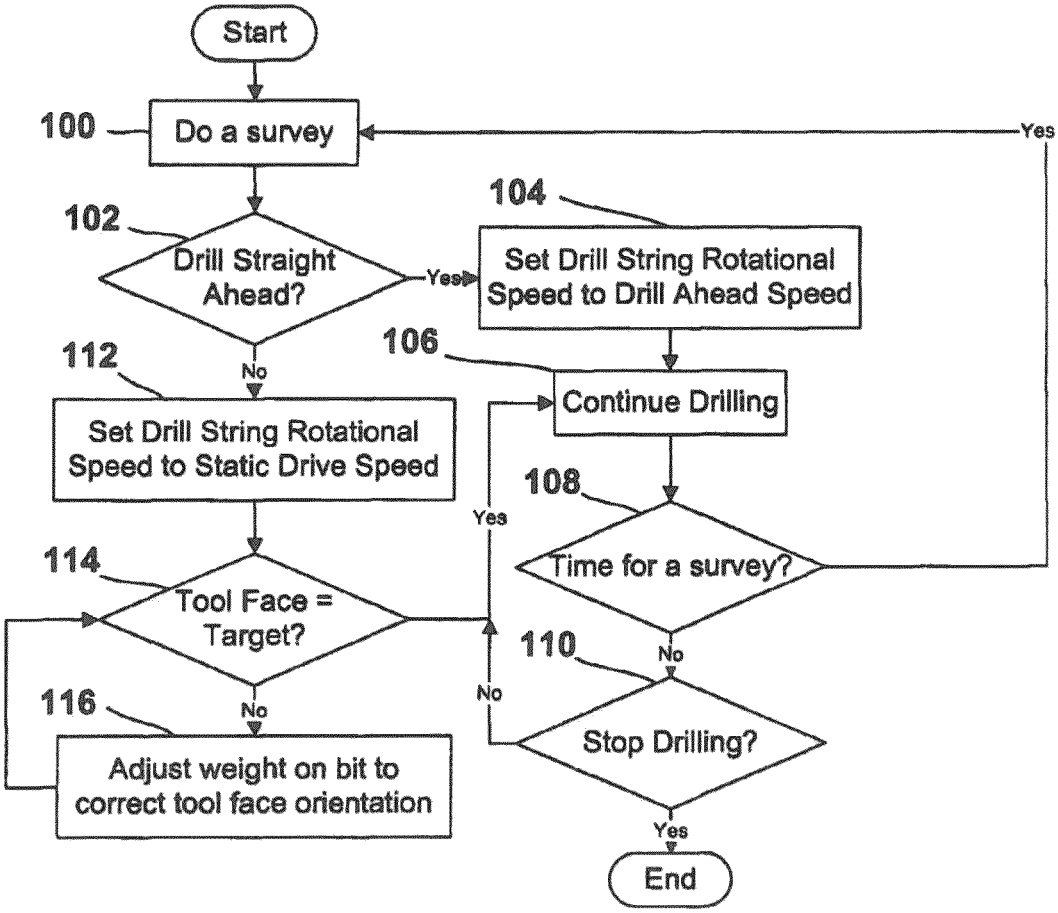
Fig. 8 PRIOR ART

FIG. 8 is a flow chart illustrating one method of drilling a bore hole using the BHA 10 or 50 in accordance with the invention. The method shown in FIG. 8 follows the traditional method of directional drilling in which weight-on-bit is manipulated by a drill rig operator to orient the drill tool face 84 for directional drilling. As is standard practice with most MWD units 28, the drill string is stopped to perform a bore hole survey (100). The bore hole survey provides an azimuth and an inclination of the bore hole, which together provide a latest update on the actual bore path. The actual bore path is then compared with a well plan, and it is decided (102) if the bore hole should be drilled "straight ahead", i.e. a linear continuation of the current azimuth and inclination. If so a rotary table or top drive unit is controlled to drive (104) the drill string rotational speed at the drill ahead speed, e.g. the static drive speed plus at least several RPM.

After the drill string 14 is driven at drill ahead speed, the BHA 10 will elongate the bore hole linearly from a current azimuth and inclination as drilling continues (106). However, periodic surveys are made to ensure that the bore hole proceeds in accordance with the well plan. It is therefore determined (108) if it is time to do a survey. If so, the survey is done (100). If not, it is determined (110) if it is time to stop drilling. If not, the drilling continues (106) until it is time to do another survey, or it is time to stop drilling.

If it is determined (102) that the well bore should not be drilled straight ahead, i.e. directional drilling is required, the rotary table or the top drive unit is controlled to set (112) the drill string rotational speed to the static drive speed for directional drilling, as explained above. It is then determined (114) by comparing the survey data with the well plan if the current drill tool face 84 corresponds to a tool face target required for the directional drilling. If not, the weight on the drill bit is controlled by the operator (116) in a manner known in the art to adjust the drill tool face 84 to conform to the tool face target. This is a manual procedure that is learned from experience. Since the drill tool face 84 is stable at static drive speed under nominal weight on bit, the operator can manipulate the weight on the drill bit to adjust the drill tool face 84. For example, increasing the weight on bit will induce more reactive torque and cause the drill tool face 84 to rotate counterclockwise, while decreasing the weight on bit will reduce the reactive torque, and the torque generator will rotate the drill tool face 84 clockwise. When the drill tool face 84 corresponds with the target tool face the operator restores the nominal weight on bit and drilling proceeds (106) until it is determined (108) if it is time for another survey or it is determined (110) that it is time to stop drilling.

Figure 9:
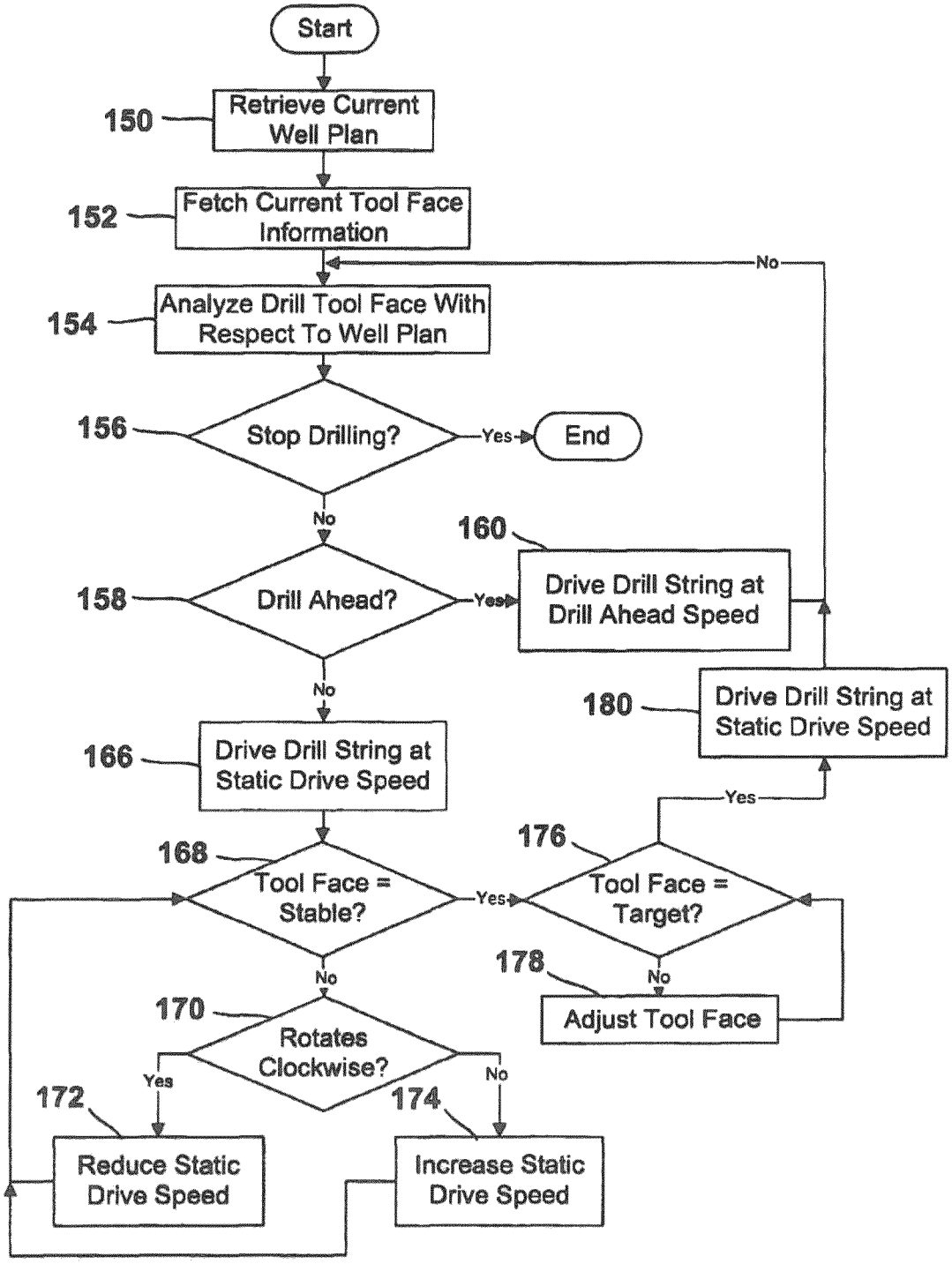
Fig. 9 PRIOR ART

FIG. 9 is a flow chart illustrating principal steps in a fully automated method of drilling a bore hole using the BHA 10 in accordance with the invention. This method is practiced using a computer control unit (not shown) that is adapted to store an entire well plan and to autonomously control the speed of rotation of the drill string 14 using drill tool face information dynamically provided by the MWD unit 28.

As shown in FIG. 9, at startup the control unit retrieves (150) a well plan previously input by an operator. The control unit then fetches (152) current drill tool face information and analyzes (154) the current drill tool face with respect to the well plan that was retrieved (150). The control unit then determines (156) if it is time to stop drilling. If so, the process ends. If not, the control unit determines (158) if the well plan calls for drilling ahead (i.e. drilling a linear bore segment from a current azimuth and inclination). If so, the control unit sets (160) the rotational speed of the drill string 14 to drive ahead speed, and the process repeats from (154). If it is determined (158) that directional drilling is required, the control unit sets (166) the rotational speed of the drill string 14 to a current (last used) static drive speed. If drilling has just commenced or just resumed, a default static drive speed input by the operator is used. The control unit then uses MWD feedback to determine (168) if the drill tool face 84 is stable. If not, the drill tool face 84 must be stabilized.

An unstable drill tool face 84 at the static drive speed can occur for any of a number of reasons that influence the reactive torque 82, such as: an operator increase of the weight on bit; a change in the formation hardness; a change in the density of the drilling mud; etc. In order to stabilize the drill tool face 84, the control unit determines (170) if the drill tool face 84 is rotating clockwise. If so the counter torque generated by the torque generator 20 is greater than the reactive torque 82. Consequently, the control unit incrementally reduces the static drive speed and again determines (168) if the drill tool face 84 is stable. If it is determined (170) that the drill tool face 84 is not rotating clockwise, the control unit incrementally increases (174) the static drive speed and again determines (168) if the tool face is stable. As soon as the drill tool face 84 is stable, the control unit determines (176) if the drill tool face 84 corresponds to the tool face target. If it is determined that the drill tool face 84 does not correspond to the tool face target, the control unit adjusts (178) the drill tool face. The control unit adjusts the drill tool face by marginally increasing (to rotate the drill tool face 84 clockwise) or decreasing (to rotate the drill tool face 84 anticlockwise) the current static drive speed for a short period of time. Concurrently, the control unit monitors the drill tool face 84 until the drill tool face 84 corresponds to the tool face target. The control unit then resumes (180) the current static drive speed set or confirmed at (166) and the process repeats from (154), as described above.

In order to keep the control unit as simple and reliable as possible, the drill operator retains control of the weight on bit. If the drill operator changes the weight on bit during directional drilling the drill tool face 84 will change and/or become unstable due to a resulting change in the reactive torque 82 generated by the mud motor 32. If so, the control unit will determine (168) that the drill tool face 84 has changed or is no longer stable. Consequently, the control unit will adjust (170)-(174) the static drive speed to compensate for the change in weight on bit and/or correct (176-178) the drill tool face 84 to correspond to the tool face target, as described above.

Current Embodiments

Depending on the particular drilling operation, the torque generator 20 of the '839 Patent can be underpowered. As stated above for the '839 Patent, it is also important that the torque output by the torque generator be more than adequate to counteract a reactive torque generated by the drill bit 42 when drilling mud is pumped through the drilling motor 32 at a predetermined flow rate to rotate the drill bit 42 against a bottom of the bore hole 12 under a nominal weight on bit (WOB). If not, then the static drive speed will not be consistent.

The torque generator counteracts reactive torque and generates torque necessary maintain the static drive speed. Under difficult drilling conditions, including a large WOB, the reactive torque can overwhelm the torque generator and the relative rotation of the BHA with respect to earth can be unpredictable. If the reactive rotation is not adequately resisted, then the transition to linear drilling can be uncertain or compromised.

Herein, a high torque, torque generator 220 is provided, with its torque generation capability limited only by the diameter of the BHA, which will be explained in detail hereinbelow. Reference numerals of the components herein are the same as assigned for like components of the '839 Patent and new reference numerals are provided for differing components.

In one aspect, the torque generator has a pump connected to a crossover assembly in a housing of the bottom-hole assembly. The pump maximizes the cross-sectional area of the housing for maximal torque generation. In this embodiment, the crossover assembly receives drilling fluid from the drill string and divides the flow of the drilling fluid to bypass some drilling fluid from the pump. The remaining drilling fluid passes through the pump and through nozzles to join the bypassed drilling fluid and the recombined drilling fluid is supplied to the drilling motor in the bottom-hole assembly.

In another aspect, the pump is a modified positive displacement motor or progressive cavity pump having a rotor fit to a stator supported by the bottom-hole assembly housing. The rotor diameter is maximized for maximal torque generation and the rotor is fit with a through bore for bypassing drilling fluid past the pump. The remaining drilling fluid passes through the pump and discharges into a nozzle annulus. One or more nozzles are provided in parallel or in series in the nozzle annulus for providing backpressure on the pump to set the planned static drive speed.

Figure 11A:
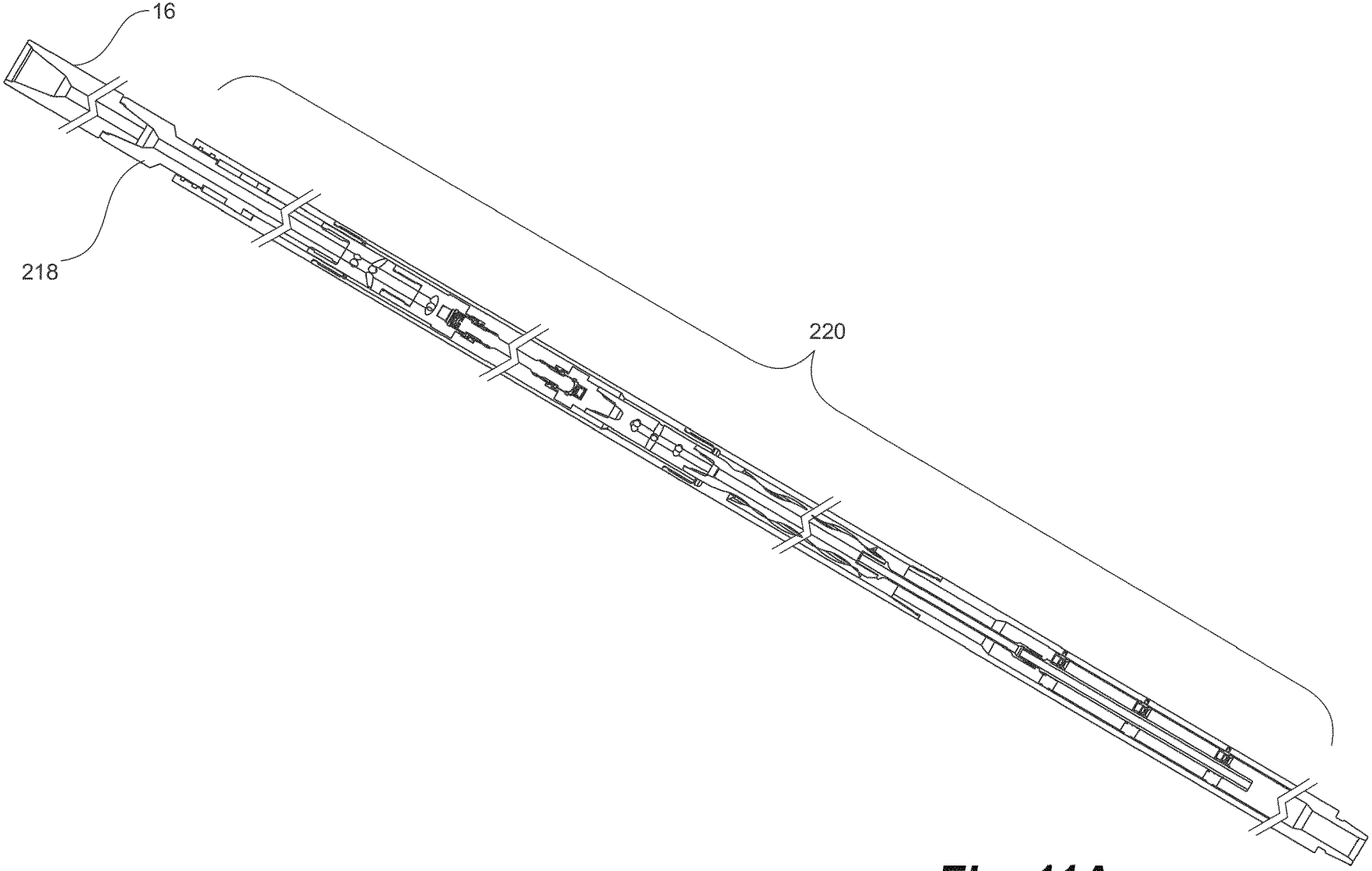
FIGS. 11A and 11B are cross sectional drawings of one embodiment of an alternate torque generator adapted to the BHA of the '839 Patent for producing high resistive torque. More particularly.
Figure 11B:
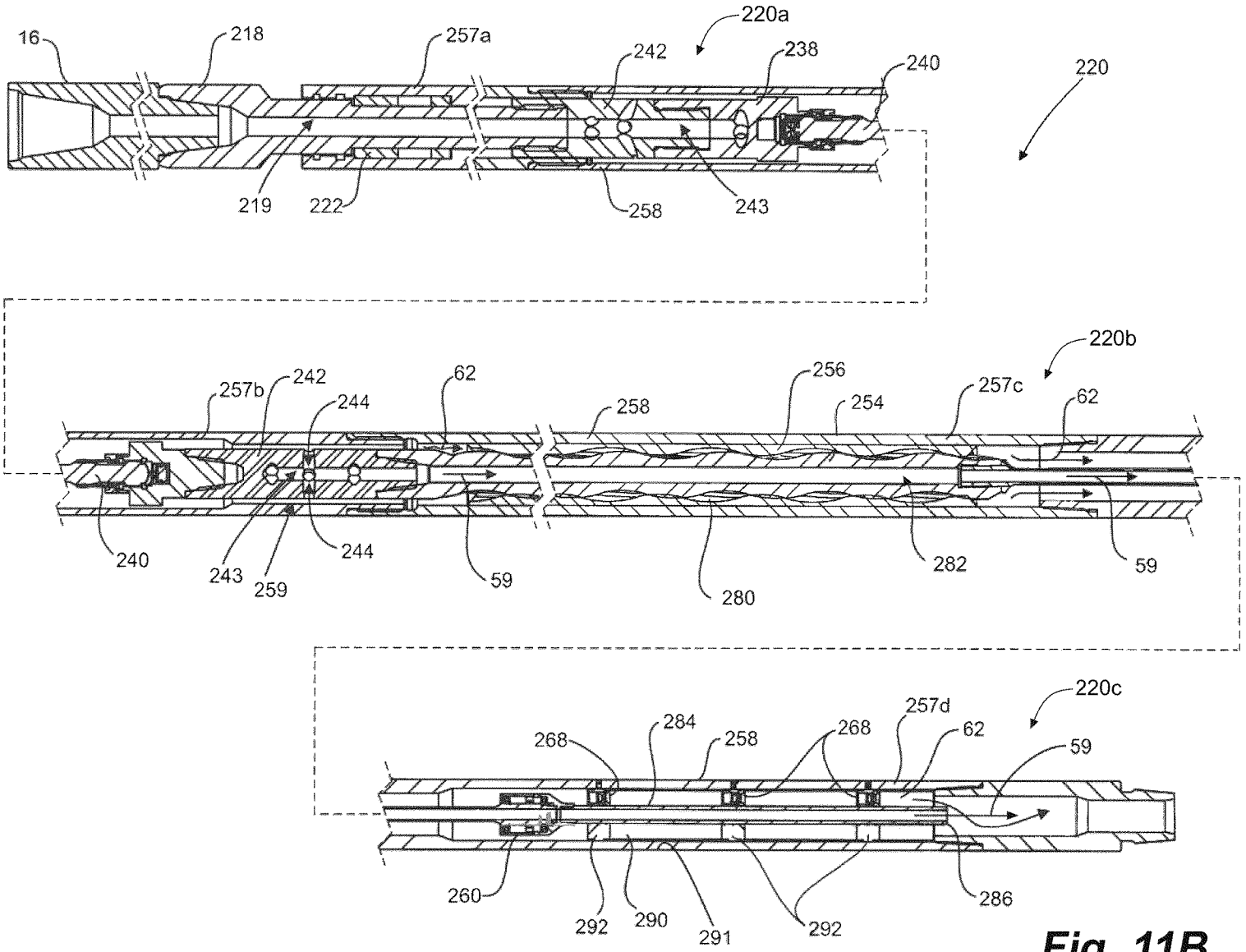

In the embodiment of FIGS. 11A and 11B, the torque generator 220 generally comprises an upper portion 220*a*, a middle portion 220*b*, and a lower portion 220*c*. Torque generator 220 comprises a positive displacement motor or progressive cavity pump having a rotor 254 and a stator 256. The diameter of the stator 256 is maximized within the torque generator housing 258. In other words, the diameter of the stator 256 is the same or about the same as the inner diameter of the torque generator housing 258. Since the diameter of stator 256 is maximized, the average diameter of rotor 254 can be increased within the stator 256, in comparison with the stator 54 of the '839 Patent. A pump chamber 280 is formed along the inner surface of the stator 256 and the rotor 254.

Unlike the torque generator 20 of the '839 Patent, there is no annulus between the stator and the torque generator housing in the torque generator 220 for bypass flow 59 to flow. Instead, rotor 254 has a central bore 282 extending therethrough to provide a passage for bypass flow 59. Since there is no annulus between the stator 256 and the torque generator housing 258, the diameter of the rotor and/or stator in the torque generator 220 can thus be maximized for maximal torque generation.

Figure 10A:
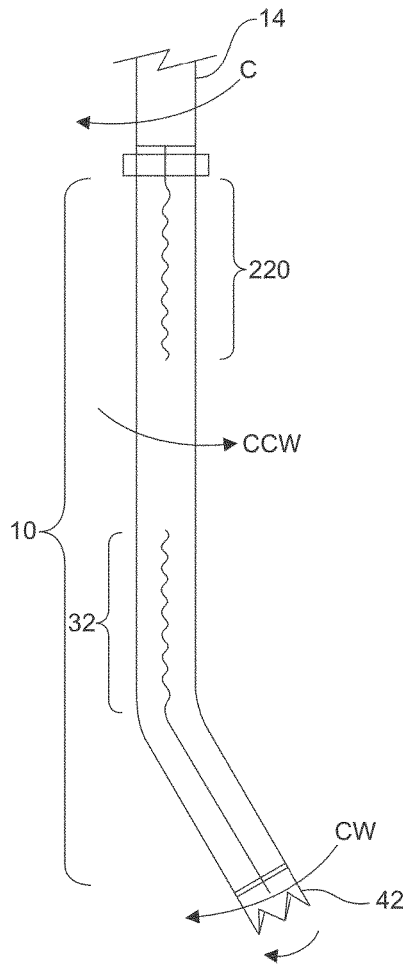
FIGS. 10A, 10B and 10C are schematic drawings of a bottom-hole assembly located at a distal end of a rotary drive string, the BHA having a drill bit powered by a drilling motor, and the BHA rotatable independent of the drill string, the rotation of which being controlled by a torque generator. More particularly.

In the embodiment of FIGS. 10A, 11A, and 11B, the torque generator 220 generally comprises two assemblies: a first assembly for coupling with the drill string and for rotation in a first direction (e.g. CW rotation); and a second assembly having the torque generator housing 258 for rotation in a second direction, opposite to the first direction (e.g. CCW rotation). When drilling fluids are distributed from the drill string 14 to torque generator 220, the torque generator 220 supplies the drilling motor 32 with drilling fluids to drive the drill bit in a CW direction.

The first assembly, from the uphole end adjacent the driveshaft connector 16, comprises a bearing pack 218 having a bearing sub 222 for rotational coupling with the torque generator housing 258 and a central bore 219 extending therethrough for receiving drilling fluids from the drill string 14 via connector 16. Connected to the downhole end of the bearing pack 218 is a crossover unit 242 which is a sub having a central bore 243 extending therethrough and in fluid communication with the bearing pack bore 219. The crossover 242 is fit with one or more radial passages 244 for directing some drilling fluid from the bore 243 to a housing annulus 259 defined between the crossover 242 and the housing 258. The crossover 242 can thus divide drilling fluids flowing therethrough into two flows: a torque generator flow 62 through passages 244 and a bypass flow 59 through bore 243.

In some embodiments, the crossover includes a splitter 238 in an uphole portion of the crossover for reducing the velocity of the fluid entering the crossover bore 243 from the bearing pack bore 219. The crossover may further include a driveshaft 240 for connecting splitter 238 to the downhole portion of the crossover, for example where the passages 244 are situated. The driveshaft 240 transmits torque from the splitter to the downhole portion of the crossover unit 242.

The crossover unit 242 is connected to the uphole end of the rotor 254 for transmitting torque from the bearing pack 218 to the rotor 254. The crossover bore 243 is in communication with the rotor bore 282 for supplying drilling fluids (i.e. bypass flow 59) thereto. The housing annulus 259 is fluidly contiguous with the pump chamber 280 for supplying torque generator flow 62 thereto. The rotation of the drill string rotates the bearing pack, the crossover, and the rotor. The rotation of the rotor 254 within the stator 256 generates negative pressure in the pump chamber 280 which helps draw or pump the torque generator flow 62 out of the crossover bore via passages 244 and into the pump chamber 280.

The downhole end of the rotor 254 is fit with an extension tubular conduit 284 for directing bypass flow 59 from rotor bore 282 to a discharge end 286. As shown, the tubular conduit 284 has an uphole portion rotatable with the rotor 254 and drill string 14, and a downhole portion which may be rotatable with the torque generator housing 258. Between the uphole and downhole portions of the conduit 284 is a rotary seal 260 to maintain a pressure differential between the torque generator flow 62 outside the conduit 284 and the bypass flow 59 inside the conduit 284.

The second assembly comprises the torque generator housing 258 that extends from the uphole end adjacent the driveshaft connector 16. A downhole end of the torque generator housing 258 is connectable to an uphole end of the BHA housing. Thus, the torque generator housing may be considered as part of the BHA housing (i.e. an uphole portion of the BHA housing).

The torque generator housing 258 comprises, from the uphole end to the downhole end, a complementary bearing housing 257*a* for rotational coupling with the bearing pack 218; first tubular housing 257*b* for housing the crossover 242; a stator housing 257*c* supporting the stator 256; and a second tubular housing 257*d* for defining a nozzle annulus 290 therein. The downhole end of the second tubular housing 257*d* is configured to be coupled downhole to the bent sub and drilling motor per that disclosed in the '839 Patent. The second assembly allows the BHA housing therebelow to rotate independently of the bearing pack 218 and thus the drill string 14.

The nozzle annulus 290 is formed between the torque generator housing 258 and the tubular conduit 284. One or more annular walls 292 are provided in the nozzle annulus 290, the annular walls being axially spaced apart from one another, and each annular wall 292 having one or more nozzles 268 therein for controlling the fluid pressure of the torque generator flow 62 passing therethrough. The combination of the tubular conduit and the one or more nozzles inside the nozzle annulus is referred to herein as a "pressure sub".

The nozzle(s) 268 are selected at the surface before running the BHA 10, 50 into the well. The selection of the nozzle(s) 268 is based on, for example: an anticipated reactive torque generated by the mud motor 32 under a nominal weight-on-bit at an average formation density; a planned static drive speed for the drill string 14 during directional drilling and resulting counter torque generation at the planned static drive speed; and, an anticipated nominal mud density. The nozzle(s) 268 may be specially designed, or comprise one or more standard bit jet nozzles. The nozzle(s) 268 can be arranged in series in spaced annular walls 292 or parallel within an annular wall, or both. In another embodiment, nozzle(s) 268 can be staged for adjusting the resistive torque of the generator 220, such staging generally reducing or preventing the flow and pressure drop of one nozzle from impacting or interfering other nozzles. For example, in the embodiment illustrated in FIG. 11B, the stage shown has three nozzles 268 arranged in parallel to produce a calculated pressure drop. The torque generator may have additional stages for producing prescribed pressure drops at different drill string rotational speeds. The configuration of the nozzles in each stage as well as the number of stages in the torque generator helps define the performance curve of the bottom-hole assembly.

In operation, drilling fluids are distributed from the drill string 14 to the bearing pack bore 219 via the driveshaft connector 16. The drilling fluids then flow to the crossover bore 243 from the bearing pack bore 219. The rotation of the rotor 254 caused by the rotation of the drill string generates suction in the pump chamber 280, which pumps some of the drilling fluids out from the crossover bore 243 into the housing annulus 259 via passages 244 and through pump chamber 280, while the remaining fluid in the crossover bore 243 flows through the rotor bore 282 to bypass the pump. The crossover 242 thus divides the drilling fluids into the torque generator flow 62 and the bypass flow 59 as the rotor 254 rotates. The torque generation flow 62 enters nozzle annulus 290 as a pressurized mud flow after it is pumped through the pump chamber 280. In the nozzle annulus 290, the torque generator flow 62 is forced through the one or more nozzles 268. At the discharge end 286, torque generator flow 62 discharged from the nozzle(s) 268 and the bypass flow 59 discharged from the conduit 284 recombine to power the drilling motor 32 downhole from the torque generator 220.

As the housing 258 and the tubular conduit 284 are contra-rotating, the annular walls 292 either pose as one or more differential rotational interfaces or the downhole portion of the conduit 284 is rendered rotational with the housing 258.

The torque generated by the torque generator 220 is regulated by controlling the rotational speed of the drill string 14. At the static drive speed, the drill string 14 induces the torque generator 220 to generate a torque that counterbalances a reactive torque generated by rotation of the drill bit 42 of the bottom-hole assembly as it turns against the bore hole and the bottom-hole assembly is rotationally stabilized to drill the nonlinear bore segment, whereas rotation of the drill string at a speed other than the static drive speed causes rotation of the bottom-hole assembly to drill the linear bore segment.

Figure 10B:
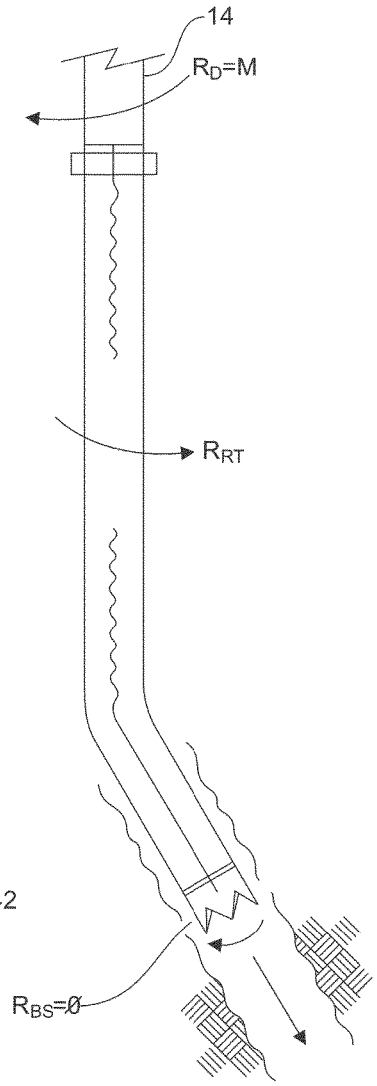
Figure 10C:
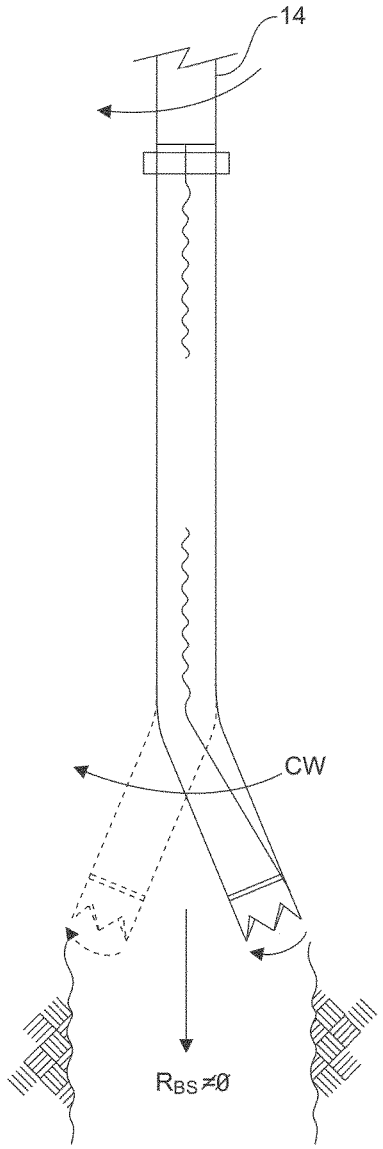

As would be understood, the present torque generator 220 is operative to provide means for improved control over directional drilling. FIG. 10A shows a general arrangement of the BHA 10 having the torque generator 220 and the drilling motor 32 for driving the drill bit 42. The drill string 14 is rotatable CW while the BHA is rotatable CCW. As illustrated in FIG. 10B, when the drill string CW rotation speed (Ro) is balanced with or equal to the reverse, CCW reactive rotation speed of the BHA ($R_{RT}$), the net rotation speed of the bent sub relative to the formation ($R_{BS}$) is neutral or zero for non-linear drilling. In other words, when $R_{RT}$ is at the static drive speed, $R_{BS}$ is zero. When Ro is greater than $R_{RT}$, as illustrated in FIG. 10C, $R_{BS}$ is greater than zero for effecting linear drilling. When $R_D$ is less than $R_{RT}$, $R_{BS}$ is less than zero.

By way of example, if the torque generator 220 is underpowered, the entire BHA will rotate in one direction (relative to the drill string) with whatever torque is provided to the torque generator in the opposite direction. For example, it is contemplated that the BHA may be rotated CCW by overpowering the torque generator, and may be rotated CW by overpowering the drilling motor. For example, about 5,000 ft-lbs of torque by the torque generator and about 8,000 ft-lbs of torque at the drilling motor may result in rotation, at a certain speed, of the BHA CCW, or in the same direction as the drilling motor, because the torque generator is being overpowered. In the reverse scenario, 8000 ft-lbs of torque by the torque generator and 5,000 ft-lbs of torque at the drilling motor may result in rotation, at a certain speed, of the BHA CW, or in the opposite direction as the drilling motor, because the torque generator overpowers the drilling motor.

Accordingly to embodiments herein, alternative configurations of the torque generator 220 are possible. For example, the torque generator 220 may have a pressure sub between the crossover 242 and the positive displacement motor, such that the torque generator flow 62 passes through the nozzle(s) before reaching the positive displacement motor. The crossover bore 243 is fluidly connected to the rotor bore 282 via the tubular conduit such that the bypass flow 59 can flow from the crossover bore 243 into the rotor bore 282 via the tubular conduit, thereby bypassing the nozzle(s). In this sample configuration, the pressure sub creates a pressure differential across the positive displacement motor to generate torque. In some embodiments, the torque generator 220 comprises one pressure sub which may be positioned uphole or downhole from the pump. In other embodiments, the torque generator 220 has two or more pressure subs which may be positioned uphole and/or downhole from the pump. It would be understood that other alternative configurations are contemplated and encompassed herein.

In some embodiments, for example where the drill string includes a safety joint, the bearing pack 218 can be selectively rotationally locked (in other words, rotationally coupled) to the housing 258 or the pump. Rotationally locking the bearing pack 218 to the housing or the pump allows torque to be transferred to the safety joint for undoing same in the event that the tool becomes stuck in the wellbore during drilling.

For example, the selective rotational locking of the bearing pack may be accomplished by using a sprag clutch, which is a one-way freewheel clutch, as the bearing sub 222 or in addition to the bearing sub 222. The sprag clutch allows the torque generator to rotate in one direction, i.e. clockwise, but when the opposite rotation (i.e. counterclockwise) is applied, the sprag clutch locks the bearing pack 218 so it does not rotate relative to the housing 258 or the stator 256. Once the bearing pack is rotationally locked, mechanical (counterclockwise) torque can be transferred to the safety joint. As can be appreciated by those in the art, other ways of selectively rotationally locking the bearing pack are possible.

Therefore, an improved torque generator is provided for increased torque generation.

In one aspect, a torque generator is provided for use in a bottom-hole assembly comprising: a housing having a housing inner diameter; a bearing pack rotationally coupled to the housing, the bearing pack being connectable to a drill string and having a bearing pack bore extending therethrough for fluid communication with the drill string; and a pump inside and supported by the housing and having a pump chamber and a cross-sectional area which is maximized within the housing inner diameter; one or more nozzles inside and supported by the housing, downhole from the pump and in fluid communication with the pump chamber; a bypass conduit extending through the inside of the pump and bypassing the pump and the one or more nozzles, and having a discharge end downhole from the one or more nozzles; and a crossover having an inlet and two or more outlets, the inlet being in fluid communication with the bearing pack bore for receiving fluid therefrom, and at least one of the two or more outlets in fluid communication with the pump chamber for providing some of the fluid thereto, and the remaining outlets in fluid communication with the bypass conduit for providing the remaining fluid thereto.

In another aspect, a torque generator is provided for use in a bottom-hole assembly connectable to a drill string for drilling linear and nonlinear subterranean bore segments, and the torque generator comprises a first assembly and a second assembly. The first assembly is configured to be coupled to the drill string for rotation in a first direction, e.g. CW; and the second assembly is configured to be rotatable in a second direction, opposite the first direction, e.g. CCW. The second assembly allows part of the BHA therebelow (i.e. the BHA housing) to rotate in the second direction.

In some embodiments, the first assembly comprises: a bearing pack having a bearing pack bore extending therethrough for fluid communication with the drill string, the bearing pack being connectable to the drill string; a bearing sub coupled to the bearing pack; a crossover connected to a downhole end of the bearing pack and in communication with the bearing pack bore, the crossover having one or more passages for dividing fluid flowing therethrough into a torque generator flow and a bypass flow; a rotor connected to the crossover, the rotor having a rotor bore extending therethrough for passage of the bypass flow; and a tubular conduit connected to a downhole end of the rotor and in fluid communication with the rotor bore.

The second assembly comprises: a torque generator housing rotationally coupled to the bearing pack via the bearing sub; and a stator supported on the inner surface of the torque generator housing and having a diameter substantially the same as the inner diameter of the torque generator housing, and the rotor being positioned in the stator for operation therewith, wherein the torque generator housing assembly houses the crossover, the stator, the rotor, and the tubular conduit, wherein a pump chamber is defined between the rotor and the stator for passage of the torque generator flow, and wherein a nozzle annulus is defined between the torque generator housing and the tubular conduit.

In some embodiments, the first assembly and the second assembly are selectively rotationally lockable and unlockable relative to one another. For example, the first and second assemblies may be configured to allow the first assembly to rotate relative to the second assembly when a clockwise rotation is applied to the first assembly; however, when a counterclockwise rotation is applied to the first assembly, the first assembly is locked to the second assembly such that the first assembly does not rotate relative to the second assembly. Rotationally locking the first assembly relative to the second assembly allows the transfer of torque from the first assembly to the second assembly.

The torque generator further comprises one or more annular walls in the nozzle annulus and one or more nozzles in each annular wall for controlling a fluid pressure of the torque generator flow passing therethrough.

The torque generator permits the bottom-hole assembly to rotate independently of the bearing pack and the drill string.

Figure 12A:
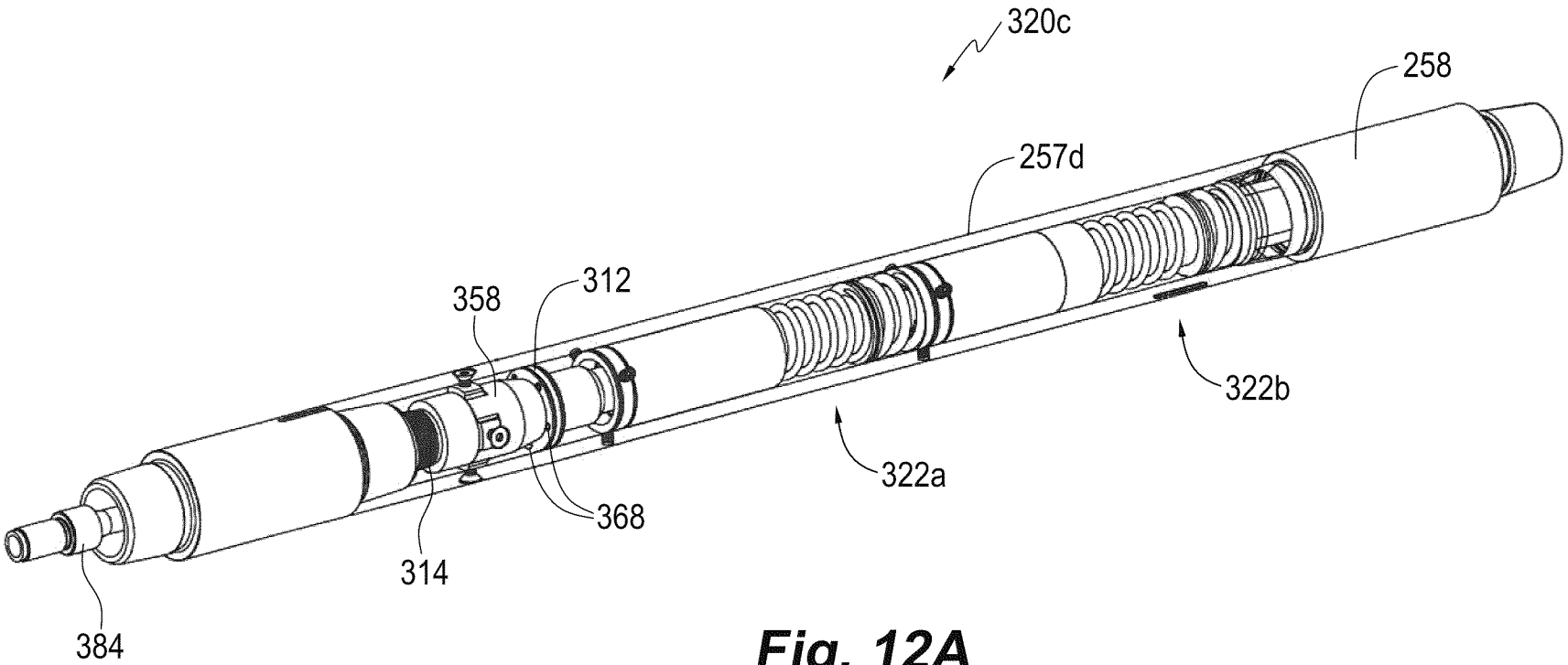
FIGS. 12A and 12B are a side perspective view and a cross-section view of one embodiment of an alternative lower portion usable in the torque generator shown in FIGS. 11A and 11B. More particularly.
Figure 12B:
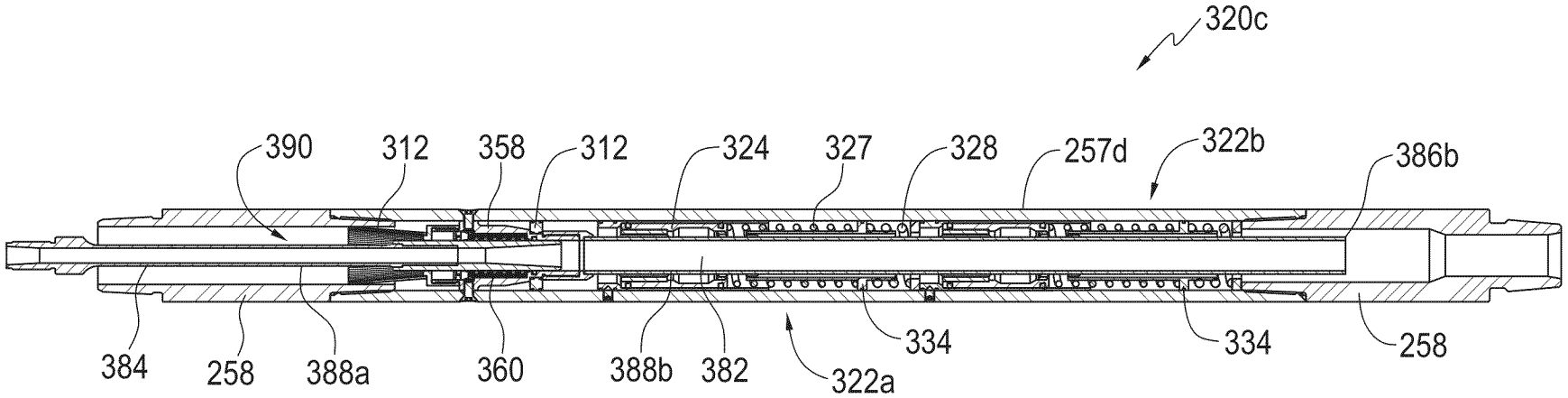

FIGS. 12A and 12B show an alternative lower portion 320*c* that can be used in the torque generator 220 instead of the lower portion 220*c*. The lower portion 320*c* (also referred to as "tool face controller") is configured to allow the selective fine tuning of the rpm of the face of the drill bit (i.e., the tool face). In other words, the inclusion of lower portion 320*c* in the torque generator allows high resolution tool face control over a larger (and tuneable) range of drill string rpm set points. This helps to maximize the tool's performance while maintaining an optimal resolution for tool face control.

Figure 13:
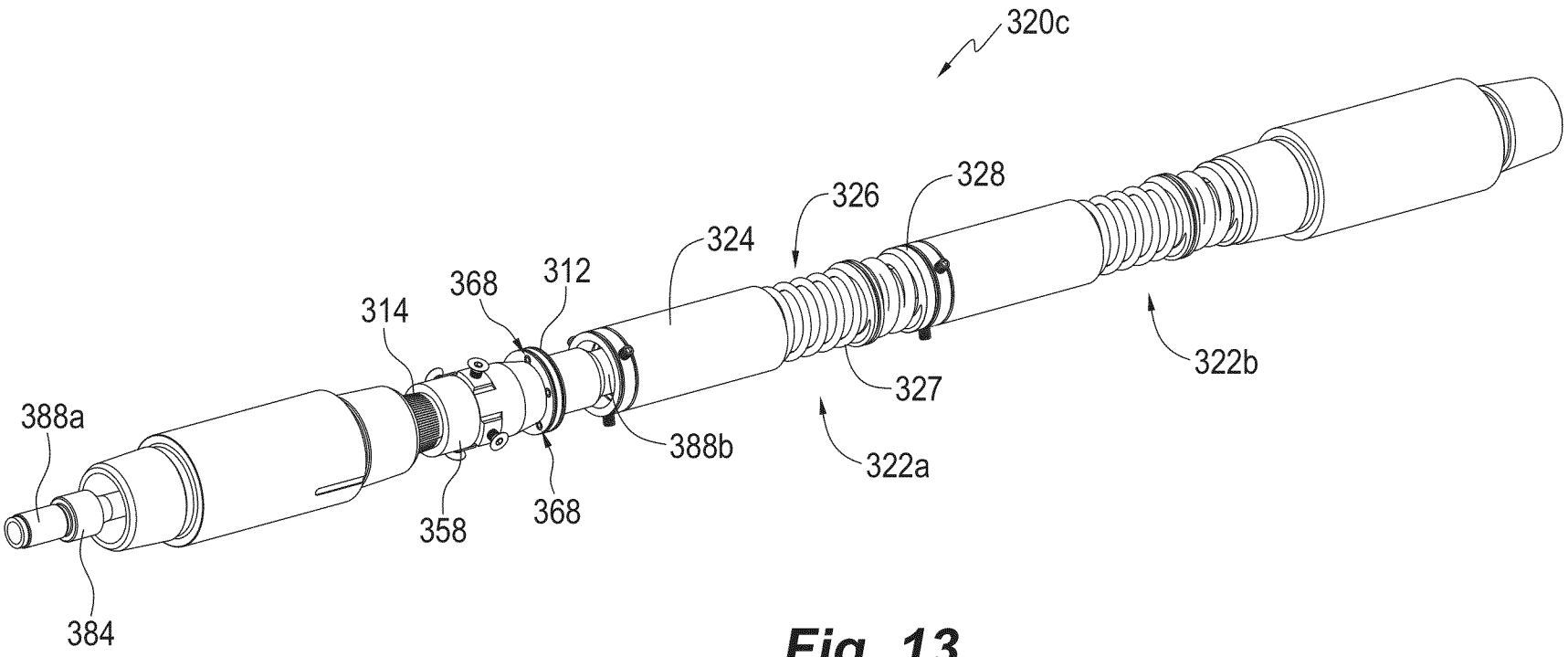
FIG. 13 is another side perspective view of the alternative lower portion shown in FIG. 12A, with additional components omitted to provide a full view of the piston assemblies therein.

In one embodiment, with reference to FIGS. 12A, 12B, and 13, the second tubular housing 257*d* of the torque generator housing forms the outer tubular of the tool face controller 320*c*. The downhole end of the second tubular housing 257*d* is configured to be coupled downhole to the bent sub and drilling motor per that disclosed in the '839 Patent. Similar to lower portion 220*c* described above, the tool face controller 320*c* comprises an extension tubular conduit 384 having an axially extending inner bore 382; an upper end for connection with the downhole end of the rotor 254; and a lower discharge end 386. When the conduit 384 is connected to the rotor 254, inner bore 382 is in fluid communication with the central bore 282 of the rotor and at least a portion of the conduit 384 is rotatable with the rotor 254 and drill string 14. The conduit 384 extends substantially axially through the inner bore of the second tubular housing 257*d*, thereby defining an annulus 390 therebetween.

In some embodiments, conduit 384 comprises an upper conduit portion 388*a* that is rotatable with the rotor 254 and drill string 14, and a lower conduit portion 388*b* which may be rotatable with the torque generator housing 258. In the illustrated embodiment, the tool face controller 320*c* further comprises a bearing housing 358 having a plurality of bearings 360 therein. The bearing housing 358 is positioned in the annulus 390 and is fixedly attached to the housing 257*d*. A portion of the upper conduit portion 388*a* extends into the bearing housing, thereby engaging the plurality of bearings 360 and thus allowing the upper conduit portion 388*a* to rotate within the bearing housing 358 without imparting any torque to the second tubular housing 257*d*.

The upper end of the lower conduit portion 388*b* is attached to the bearing housing 358 so that it is stationary relative to the second tubular housing 257*d* while it is rotatable relative to the upper conduit portion 388*a*. In other words, the upper conduit portion 388*a* and lower conduit portion 388*b* may be rotatable in opposite directions, relative to one another, about a common central longitudinal axis.

In embodiments, the tool face controller 320*c* comprises a flow distributor 312. The flow distributor 312 is positioned in the annulus 390 and may be supported on the bearing housing 358, as illustrated, or on the extension conduit 384. The flow distributor 312 comprises one or more apertures or nozzles 368 for directing the flow of the at least a portion of the fluids into a torque generator fluid flow 62 into the annulus 390. That is, the flow distributor 312 comprises a plurality of fluid flow distributors 368 that allow fluid in the annulus 390 to flow from above the flow distributor 312 to the annulus 390 below the flow distributor 312. As fluid passes through the distributors or nozzles 368, there is a reduction in fluid pressure across the flow distributor 312. In other words, the fluid pressure below the flow distributor 312 is less than that thereabove because the fluid flow path is constricted by the nozzles 368.

In some embodiments, the tool face controller 320*c* may further comprise a screen 314, above the flow distributor 312 for filtering out particulates in the fluid in annulus 390 before the fluid reaches the flow distributor.

Below the flow distributor 312, the tool face controller 320*c* comprises one or more piston assemblies. In the illustrated embodiment, the lower portion 320*c* comprises a first piston assembly 322*a* and a second piston assembly 322*b* in series. Each piston assembly 322*a*, 322*b* is situated in the annulus 390 and is supported on the lower conduit portion 388*b*. While the illustrated embodiment shows two piston assemblies, the lower portion 320*c* may have fewer or more piston assemblies.

Figure 14:
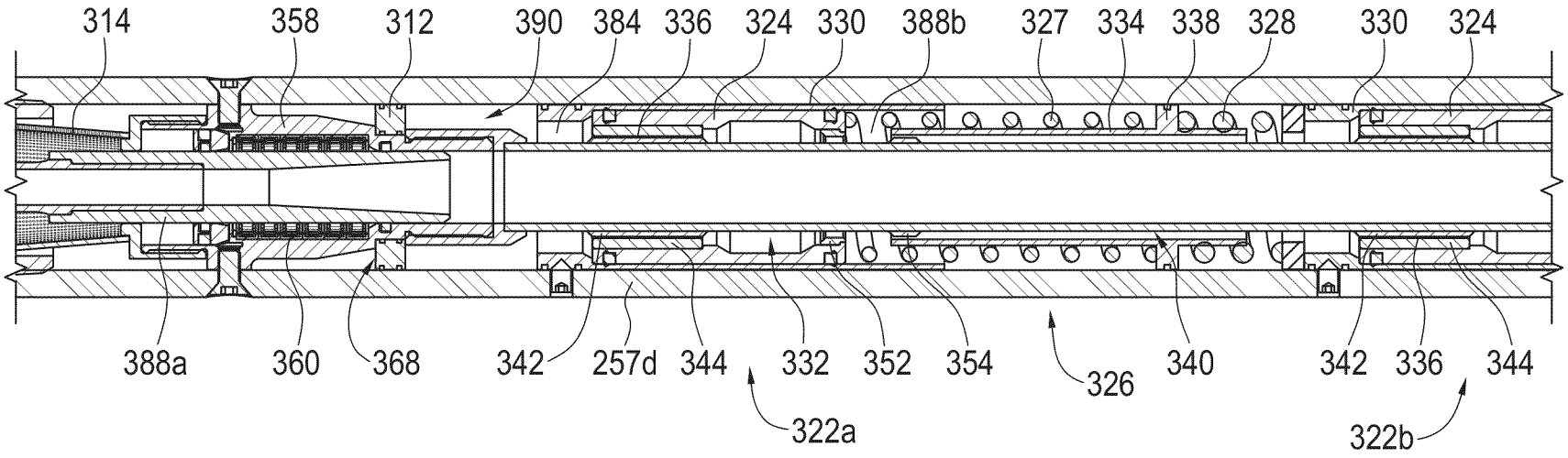
FIG. 14 is a detailed cross-sectional view of one of the piston assemblies of the alternative lower portion shown in FIG. 12B.

The first and second piston assemblies 322*a*, 322*b* have substantially identical components so only the first piston assembly 322*a* is described in detail but the description applies to both piston assemblies. The first piston assembly 322*a* comprises a piston 324 and a spring assembly 326. As best shown in FIG. 14, piston 324 is disposed in a piston housing 330 and is slidingly movable axially between an upper end and a lower end of the piston housing. The piston housing 330 is fixedly attached to the inner surface of the second tubular housing 257*d* by methods known to those skilled in the art. The piston 324 has inner axial bore through which the lower conduit portion 388*b* extends. The piston 324 is slidingly movable axially relative to both the second tubular housing 257*d* and the extension conduit 384.

In the illustrated embodiment, a piston annulus 332 is defined between the inner surface of the piston 324 and the outer surface of the lower conduit portion 388*b*. The piston annulus 332 is in fluid communication with the annulus 390 to allow fluid to flow from above the piston to below. The cross-sectional area of the annulus 332 may vary in size along the length of the piston and depending on the position of the piston 324 within the piston housing 330. In embodiments, at least a portion of the piston annulus 332 has a smaller cross-sectional area than the remaining portion, which will be referred to as a first restriction 336. The cross-sectional area of the first restriction 336 is smaller than that of the remainder of the piston annulus 332 and that of the annulus 390 such that flow is restricted when fluid reaches the first restriction 336 and an area of higher fluid pressure is created above the restriction 336.

The first restriction 336 of the piston assemblies 322*a*, 322*b* may be formed by: a radially outward protrusion (or raised surface) on the outer surface of the extension conduit 384; a radially inward protrusion on the inner surface of the piston 324; or a combination thereof. In the illustrated embodiment, as best shown in FIG. 14, the first restriction 336 is defined between a protrusion 342 on the inner surface of the piston 324 and a protrusion 344 on the outer surface of the lower conduit portion 388*b*. In the embodiment shown in FIG. 14, the protrusion 342 is a ring fitted in the inner bore of the piston 324 and the protrusion 344 is a ring fixed about the circumference of the lower conduit 388*b*. The protrusion 342 is fixedly attached to or is integral with the piston 324 such that it is stationary relative to the piston. The protrusion 344 is fixedly attached to or is integral with the lower conduit portion 388*b* such that it is stationary relative to the lower conduit portion. While continuous rings are shown, protrusions 342, 344 may or may not be continuous radially or axially. Of course, other ways of forming a restriction are possible. For example, the piston 324 may have one or more axial flow channels defined in its body.

Figures 15A, 15B, 15C:
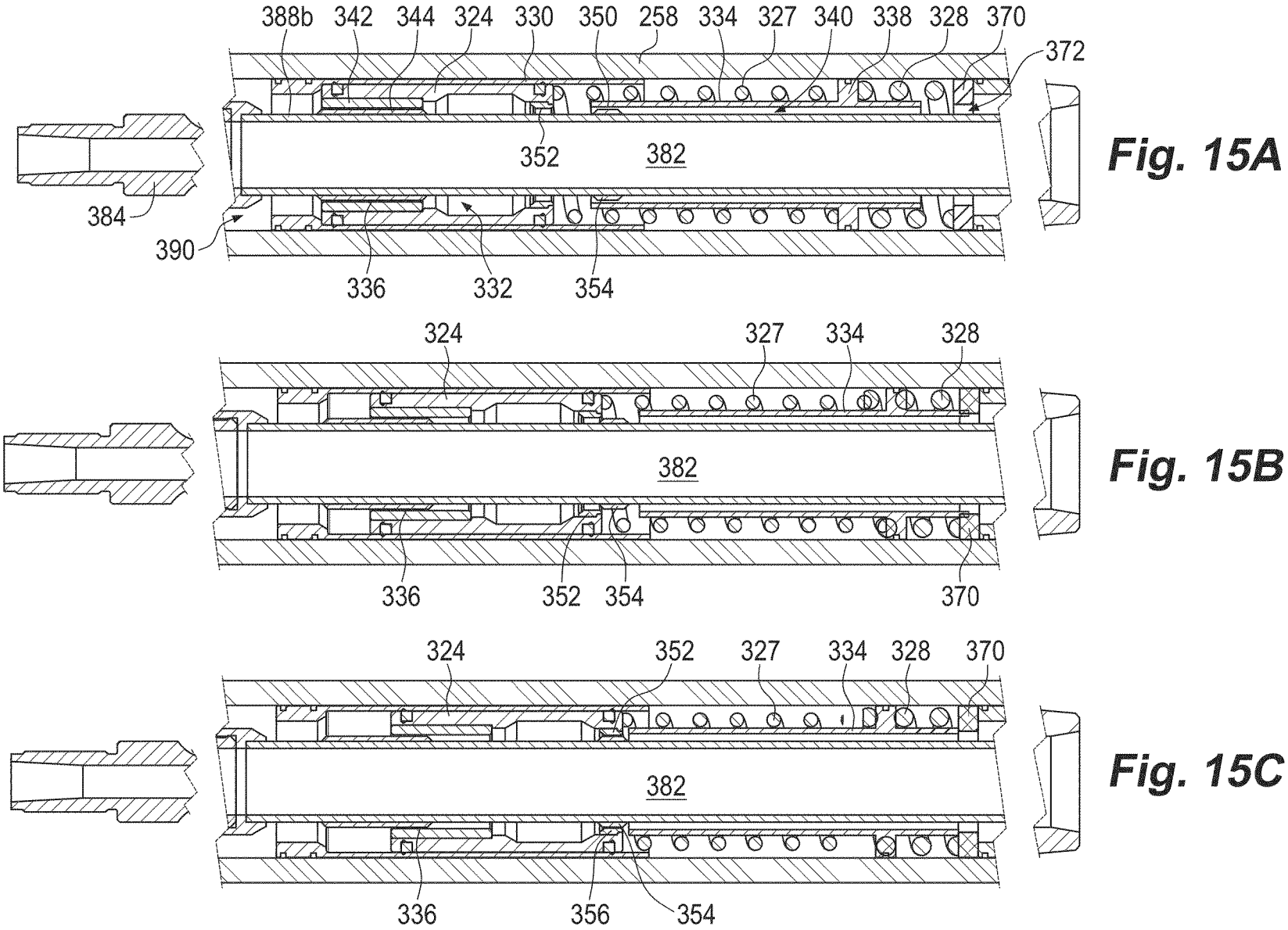
FIGS. 15A, 15B, and 15C are detailed cross-sectional views of the piston assembly shown in FIG. 14, shown side-by-side to illustrate various positions of the piston assembly.

As illustrated in FIGS. 15A to 15C, the length of the first restriction 336 may vary depending on the position of the piston 324 within the piston housing 330 relative to the extension conduit 384. For example, the restriction 336 may be longer in length when the piston 324 is at or near the upper end of the piston housing 330 than when the piston 324 is at or near the lower end of the piston housing 330. Further, the lengths of the protrusions 342, 344 may or may not be the same and may be selected to form a first restriction 336 of a desired length. Still further, the thicknesses (i.e. the inner diameter and outer diameter, respectively) of the protrusions 342, 344 may be selected to define a first restriction 336 of a desired cross-sectional area.

The interface between the piston 324 and its corresponding piston housing 330 may be fluidly sealed by one or more seals, such as o-rings, or other seals or methods known in the art, to help ensure that most or all of the fluid exiting nozzles 368 flows through the first restriction 336.

In some embodiments, as best shown in FIG. 15C, when the piston 324 is at the end of its downward stroke within the piston housing 330 (i.e., when the piston is at or near the lower end of the piston housing), a second restriction 356 is defined between the outer surface of the lower conduit portion 388*b* and the inner surface of the piston 324. The cross-sectional area of the second restriction 356 is smaller than that of the annulus 332 thereabove and the annulus 390 therebelow, such that flow is restricted when fluid reaches the second restriction 356 and an area of higher fluid pressure is created above the restriction 356.

In embodiments, the second restriction 356 is an annulus defined between the lower portion 388*b* and the piston 324 and may be formed by: a radially outward protrusion (or raised surface) on the outer surface of the extension conduit 384; a radially inward protrusion on the inner surface of the piston 324; or a combination thereof.

In the illustrated embodiment, as best shown in FIG. 15C, the second restriction 356 is defined between a protrusion 352 on the inner surface of the piston 324 and a protrusion 354 on the outer surface of the lower conduit portion 388*b*. In the embodiment shown in FIG. 15C, the protrusion 352 is a ring fitted in the inner bore of the piston 324 and the protrusion 354 is a ring fixed about the circumference of the lower conduit 388*b*. The protrusion 352 is fixedly attached to or is integral with the piston 324 such that it is stationary relative to the piston. The protrusion 354 is fixedly attached to or is integral with the lower conduit portion 388*b* such that it is stationary relative to the lower conduit portion. While continuous rings are shown, protrusions 352, 354 may or may not be continuous radially or axially.

The axial location of protrusion 354 is generally at or near the lower end of the piston housing 330. In the illustrated embodiment, when the piston 324 is at the bottom of its downward stroke, at least a portion of the protrusion 354 overlaps axially with a length of the protrusion 352. The overlap defines an annulus between the two protrusions, thereby creating the second restriction 356. In other words, the second restriction 356 only exists when there is an overlap between the protrusions 352, 354. Therefore, as best shown in FIG. 15B, when the protrusion 352 is moved away from the protrusion 354 (i.e. when the piston 324 moves upwards towards the upper end of the piston housing 330), the second restriction 356 is removed.

The length of the restriction 356 may vary depending on the position of the protrusions 352, 354 relative to one another. The longer the overlap between the protrusions 352, 354, the greater the length of the second restriction 356. Further, the lengths of the protrusions 352, 354 may or may not be the same and may be selected to form a restriction 356 of a desired length when the piston 324 is at the bottom of its downward stroke. Still further, the thicknesses (i.e. the inner diameter and outer diameter, respectively) of the protrusions 352, 354 may be selected to define a second restriction 356 of a desired cross-sectional area.

The spring assembly 326 is positioned below the piston 324. In the illustrated embodiment, each spring assembly 326 comprises an upper spring 327, a lower spring 328, and a spring sleeve 334. The spring sleeve 334 is positioned in the annulus 390 and is slidably movable axially relative to the torque generator housing 258 and the extension conduit 384, between an upper position and a lower position. At least a portion of the spring sleeve 334 is in sealing engagement with the inner surface of the second tubular housing 257*d*, which may be achieved using a seal, such as an o-ring or the like. For example, the spring sleeve 334 may include a radially extending divider 338, the circumference of which sealingly engages the inner surface of the housing 257*d*. In some embodiments, an upper axial portion of the spring sleeve 334 may extend into the inner bore of the piston housing 330. A spring sleeve annulus 340 is defined between the inner surface of the sleeve 334 and the outer surface of the extension conduit 384. The spring sleeve annulus 340 is in fluid communication with the piston annulus 332.

In the illustrated embodiment, the upper spring 327 is supported on and wound around an upper portion of the spring sleeve 334 above divider 338; and the lower spring 328 is supported on and wound around a lower portion of the spring sleeve 334 below divider 338. In some embodiments, the upper spring 327 is a softer spring or has a lower spring constant than the lower spring 328. The spring constant of the upper spring 327 may be selected to control the ease of movement of the piston 324, including the minimum fluid pressure required above the first restriction 336 to shift the piston 324 downwards and that required to place the piston 324 in its lowermost position. The spring constant of the lower spring 328 may be selected to be higher than that of the upper spring 327 in order to facilitate the recoiling of the piston 324, which will be explained in more detail below. In other embodiments, both springs 327, 328 may have the same spring constant or the lower spring 328 may have a lower spring constant than the upper spring 327.

The protrusion 354 is positioned axially on the lower conduit portion 388*b* at or near the upper end of the spring sleeve 334 and since the protrusion 354 is fixed to the lower conduit portion 388*b*, the sleeve 334 is slidably movable relative to the protrusion 354. Depending on the axial position of the sleeve 334, a portion of the sleeve 334, at or near its upper end, may overlap with the protrusion 354 to define an annulus or a third restriction 350 between the inner surface of the sleeve 334 and the protrusion 354. In the illustrated embodiment, as best shown in FIG. 15A, when the sleeve 334 is at the upper position, its upper end overlaps with the protrusion 354 to define the third restriction 350. The cross-sectional area of the third restriction 350 is smaller than that of the annulus 390 thereabove and the annulus 340 therebelow, such that flow is restricted when fluid reaches the third restriction 350 and an area of higher fluid pressure is created above the restriction 350. In some embodiments, the sleeve 334 may include a radially inward protrusion at or near its upper end or the thickness of the sleeve 334 at or near its upper end may be varied to create a third restriction 350 of a desired cross-sectional area.

Below the spring assembly 326 is a shoulder 370 for restricting the axial movement of spring sleeve 334. When the spring sleeve 334 is in the upper position, as best shown in FIG. 15A, the sleeve 334 is not in contact with the shoulder 370. When the sleeve 334 is in the lowermost position, as best shown in FIGS. 15B and 15C, the lower end of the sleeve 334 abuts against the shoulder 370 such that the sleeve 334 is prevented from moving further downward axially inside the second tubular housing 257*d*. In embodiments, shoulder 370 is fixedly secured to the second tubular housing 257*d*. Further, an annulus or a gap 372 is defined between the shoulder 370 and the outer surface of the lower conduit portion 388*b* to allow fluid to flow past the shoulder 370, from the first piston assembly to the second piston assembly and/or other components therebelow. Also, when the sleeve 334 is in the lower position, there is no overlap between the upper end of the sleeve 334 and the protrusion 354 so that the third restriction 350 is removed. Further, when the sleeve 334 is in the lower position, the upper spring 327 abuts against the lower end of the piston 324 and both the upper spring 327 and lower spring 328 are compressed.

Figure 16A:
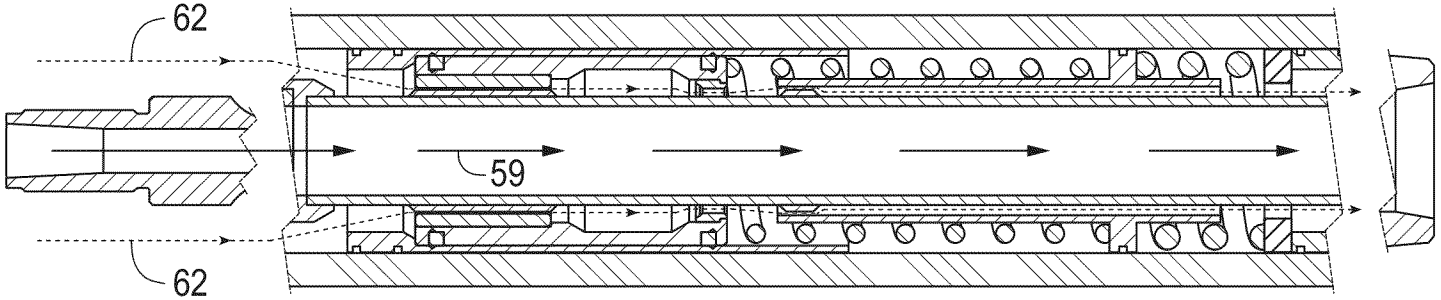
FIGS. 16A, 16B, and 16C are detailed cross-sectional views of the piston assembly shown in FIG. 14, illustrating the flow paths of the bypass flow and the torque generator flow therethrough in the various positions of the piston assembly shown in FIG. 15.

In operation, with reference to FIGS. 15 and 16, the tool face controller 320*c* is connected to the middle portion 220*b* of the torque generator such that the upper end of extension tubular 384 is attached to the rotor 254 for receiving bypass flow 59 from rotor bore 282 and the annulus 390 is ready to receive the torque generator flow 62 from the pump. Before any fluid is introduced into the torque generator, the tool face controller 320*c* is in an initial neutral position as best shown in FIGS. 15A and 16A. In the neutral position, the piston 324 is in the upper position (i.e. at the top of its upward stroke) wherein it is at or near the upper end of the piston housing 330. The upper spring 327 abuts against the lower end of the piston 324 to help maintain the piston 324 in its upper position when the tool face controller 320*c* is in the neutral position. Further, when the tool face controller 320 is in the neutral position, the upper and lower springs 327, 328 may be in a neutral position or a slightly compressed position, and the spring sleeve 334 is in the upper position such that there is some distance between its lower end and the shoulder 370.

When fluid enters the torque generator as described above, the bypass flow 59 flows through inner bore 382 and out of the extension tubular 384 via the discharge end 386 (see FIG. 16A). Further, as the rotor 254 rotates, the torque generator flow 62 is pumped from the pump chamber 280 into the annulus 390 of the tool face controller 320*c*.

From the upper end of the tool face controller 320*c*, the torque generator flow 62 flows through the filter 314, around the bearing housing 358, through the nozzles 368 of the flow distributor 312. As the fluid 62 flows through the constricted flow paths created by the nozzles 368, there is a fluid pressure drop across the flow distributor 312. After exiting the flow distributor 312, the flow 62 flows into the inner bore of the piston housing 330 of the first piston assembly 322*a*. When the torque generator flow 62 encounters the first restriction 336, which is defined by the axial overlap between the protrusions 342, 344, an area of increased fluid pressure is created immediately above the first restriction 336 as the torque generator flow 62 flows therethrough because the flow path is constricted by the first restriction 336. The increase in fluid pressure above the first restriction 336 exerts a downward force on the piston 324 to urge same towards the lower end of the piston housing 330.

Upon exiting the first restriction 336, the torque generator flow 62 continues downstream through the piston annulus 332 and then encounters the third restriction 350 defined by protrusion 354 and the inner surface of spring sleeve 334. Since the third restriction 350 constricts the flow path, an area of increased fluid pressure is generated immediately above the restriction 350, thereby urging the spring sleeve 334 to slide downwards towards the shoulder 370. When the fluid pressure above the first restriction 336 is sufficient to move the piston 324 downward, the piston 324 compresses the upper spring 327, which may in turn exert a downward force on the divider 338 and help shift the spring sleeve 334 towards the shoulder 370.

Figure 16B:
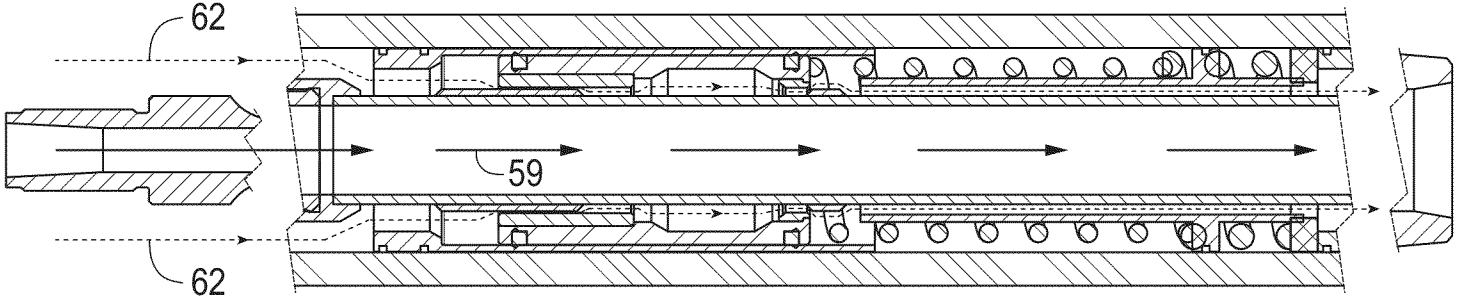

When the rpm of the drill string is constant, the piston 324 and the spring sleeve 334 eventually reach an equilibrium position wherein both the piston 324 and spring sleeve 334 are shifted downwards by some distance and wherein the spring sleeve 334 may or may not abut against the shoulder 370. Further, both springs 327, 328 are compressed. FIGS. 15B and 16B show an example of such an equilibrium position. In FIGS. 15B and 16B, the first piston assembly 322*a* is in a "mid-pressure" position, wherein the piston 324 is somewhere between the upper end and the lower end of the piston housing 330; the spring 327 is compressed by the piston 324; the spring sleeve 334 is shifted down and abuts against the shoulder 370; the spring 328 is compressed between the divider 338 and the shoulder 370; there is some distance between the lower end of the piston 324 and the upper end of the spring sleeve 334; there is no overlap between protrusions 352, 354; and there is no overlap between the spring sleeve 334 and the protrusion 354.

The position of the piston 324 can be changed by modifying the rpm of the drill string. For example, to shift the piston 324 upwards towards the upper end of the piston housing 330, the rpm of the drill string is reduced, thereby reducing the fluid pressure above the first restriction 336 and allowing spring 327 and/or spring 328 to push the piston 324 upwards. To shift the piston downwards towards the lower end of the piston housing 330, the rpm of the drill string is increased, thereby increasing the fluid pressure above the first restriction 336 to push the piston 324 down and in turn compress the springs 327, 328.

Figure 16C:
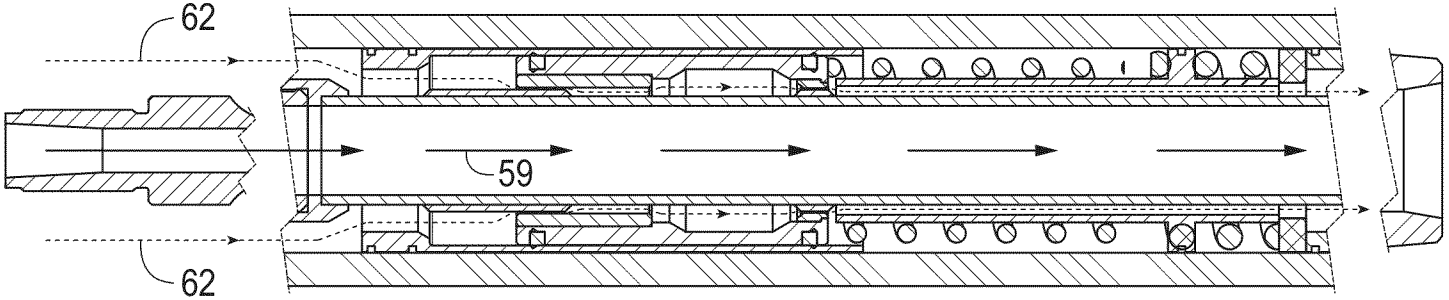

The rpm of the drill string can be increased to place the first piston assembly 322*a* in a "high-pressure" position wherein both the piston 324 and the spring sleeve 334 are shifted to their respective lowermost position. In the high-pressure position, as best shown in FIGS. 15C and 16C, the piston 324 is at the end of its downward stroke such that it is at or near the lower end of the piston housing 330; the spring 327 is compressed by the piston 324; the spring sleeve 334 is shifted down and abuts against the shoulder 370; the spring 328 is compressed between the divider 338 and the shoulder 370; the lower end of the piston 324 is adjacent or very close to the upper end of the spring sleeve 334; there is axial overlap between protrusions 352, 354 to define the second restriction 356; and there is no overlap between the spring sleeve 334 and the protrusion 354. As the torque generator flow 62 exits the first restriction 336 and flows downstream, the second restriction 356 further constricts the fluid flow path in addition to the first restriction 336 to generate a second area of high fluid pressure immediately above the second restriction 356. It is contemplated that the creation of the second restriction 356 further reduces the fluid pressure in the annulus 390 therebelow. To release the first piston assembly 322*a* from the high-pressure position, the rpm of the drill string is reduced, thereby decreasing the fluid pressure above the first restriction 335 and allowing the upper and/or lower springs 327, 328 to push the piston 324 back up.

As discussed above, the upper spring 327 may be selected to be a softer spring than lower spring 328. The spring constant of upper spring 327 may be selected to control the ease of movement of the piston 324, i.e., to determine the minimum pressure required above the first restriction 336 to shift the piston 324 downwards and the pressure required to place the piston 324 in the lowermost position. In other words, the softness of the upper spring 327 helps determine the range of drill string rpms that places the first piston assembly 322*a* in the mid-pressure position and the drill string rpm that places same in the high-pressure position. The spring constant of the spring 328 may be selected to facilitate the recoiling of the piston 324 when the rpm of the drill string is reduced and especially from the high-pressure position wherein the piston 324 is at its lowermost position.

In embodiments, the first piston assembly 322*a* may or may not be in the same position as the second piston assembly 322*b* at the same time. For example, the first piston assembly 322*a* may be in the mid-pressure position while the second piston assembly 322*b* is in the high-pressure position.

While the tool face controller 320*c* is described to operate with the rotor-stator-type pump of the torque generator 220, a skilled person in the art can appreciate that the tool face controller 320*c* can be used with other types of pump or motor.

In embodiments, the tool face controller 320*c* creates cascading pressure drops across each stage of the controller 320*c*. For example, the controller 320*c* may generate a certain amount of fluid pressure drop (e.g. about 200 psi) across each of the flow distributor 312, the first piston assembly 322*a*, and the second piston assembly 322*b*. Of course, one or more additional stages, such as additional flow distributors and/or piston assemblies, may be included in the controller 320*c* to generate further reduction(s) in fluid pressure as the torque generator flow 62 flows downstream through the controller 320*c*. Further, the movable piston 324 in each piston assembly 322*a*, 322*b* dynamically reacts to changes in the fluid pressure thereabove and its ability to move axially provides a buffer to such pressure changes for the BHA components therebelow.

This cascading reduction in fluid pressure of the tool face controller 320*c* and the dynamic reaction of the piston assemblies 322*a*, 322*b* help to reduce the sensitivity of the tool face in response to changes in the drill string rpm. In prior art torque generators, even a slight change in drill string rpm can translate to large movements of the tool face. The tool face controller 320*c* of the present disclosure aims to maintain the performance of torque generator while minimizing the effect rpm changes have on the tool face over a range of drill string rpms. When it is desirable to drill substantially straight ahead in a subterranean formation, the rpm of the drill string can be revved up to place the first and/or second piston assemblies in the high-pressure position such that maximum torque is achieved in the torque generator with minimal directional movement in the tool face.

Figure 17A:
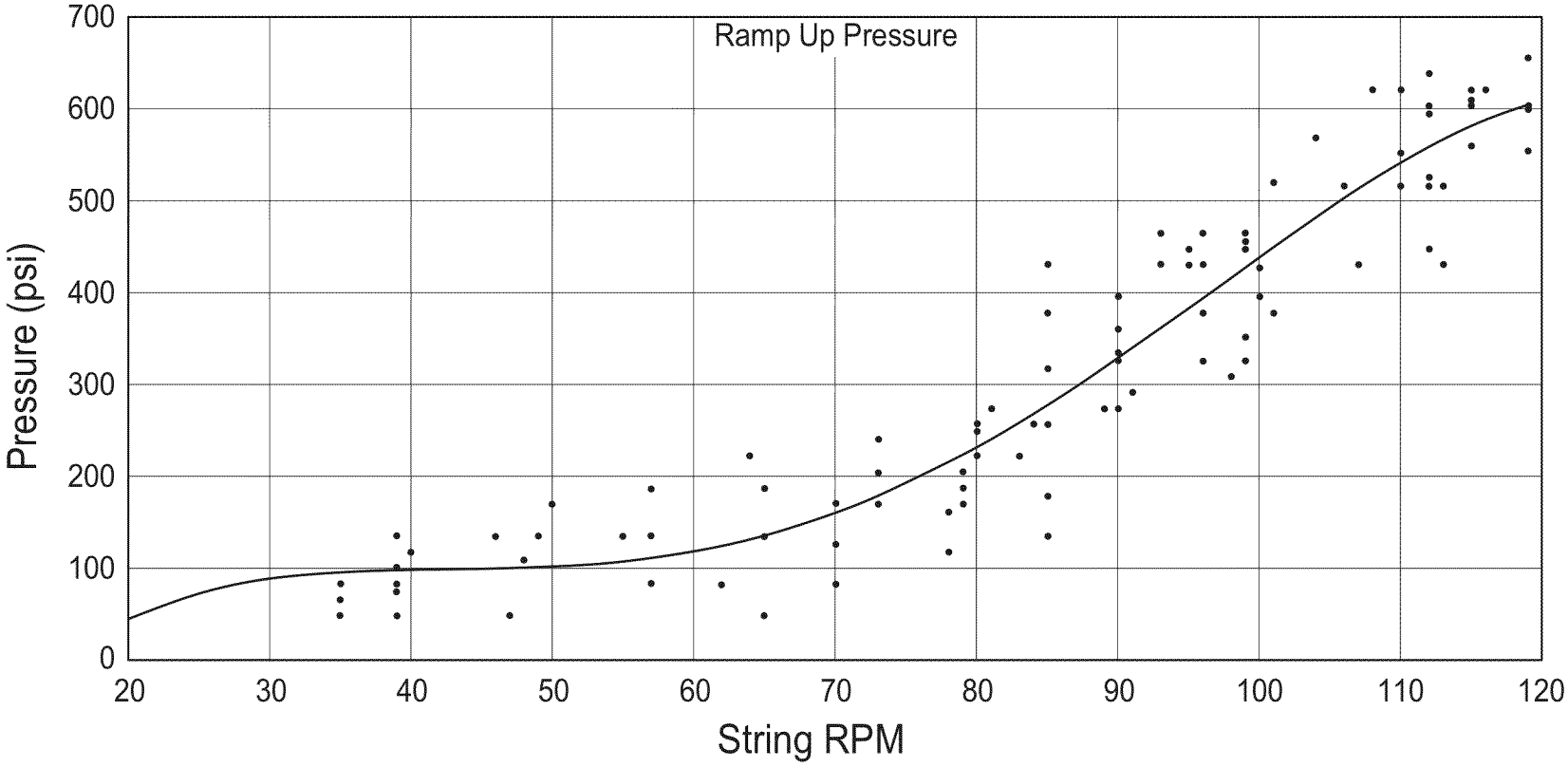
FIG. 17A is a graphical illustration of a sample pressure profile generated by the inclusion and operation of the alternative lower portion.
Figure 17B:
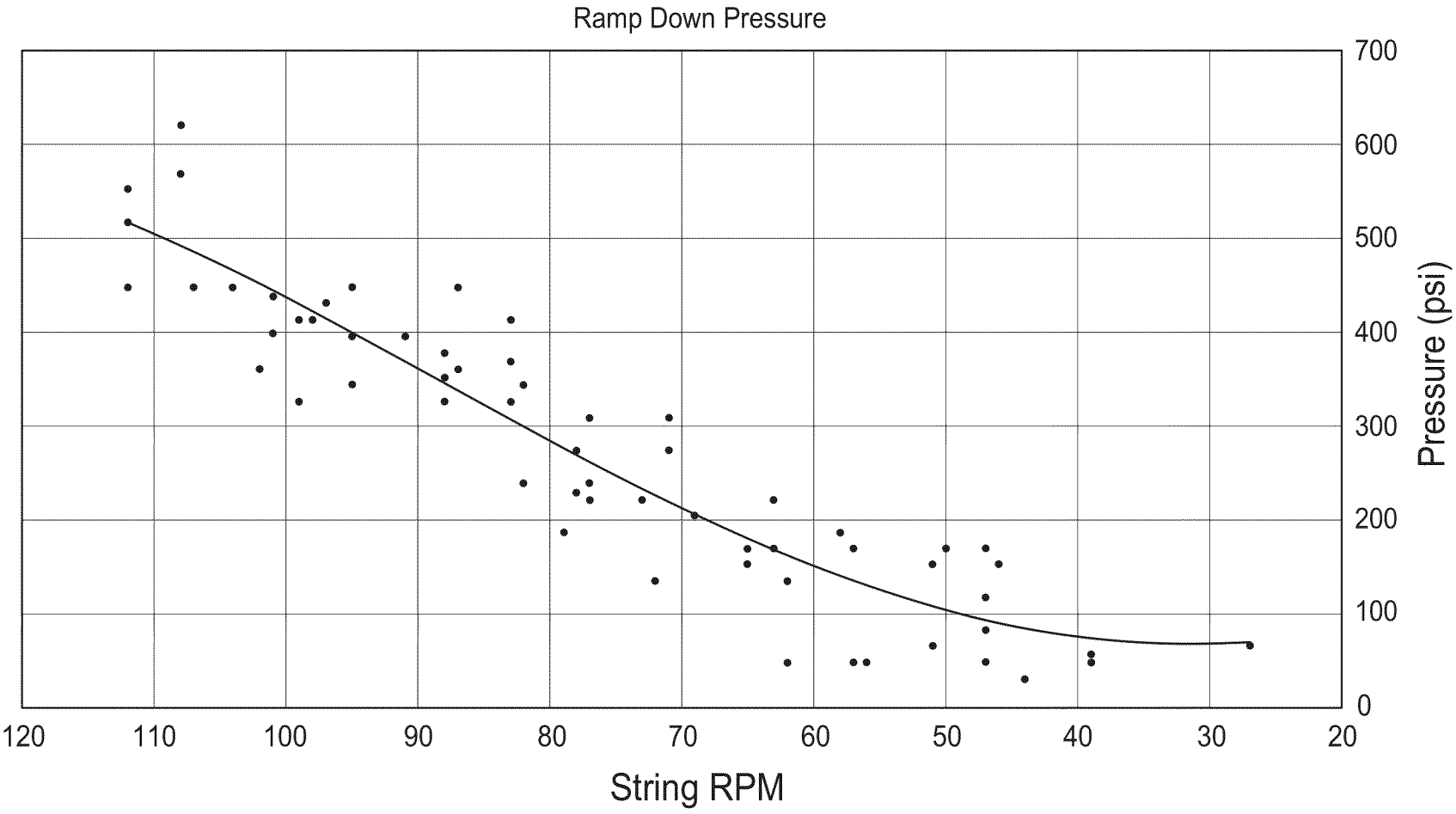
FIG. 17B is a graphical illustration of another sample pressure profile generated by the inclusion and operation of the alternative lower portion.

FIGS. 17A and 17B are graphical representations of sample pressure profiles of the torque generator 220 having the tool face controller 320*c*. As shown in FIG. 17A, the pressure (and thus the torque) of the torque generator 220 can be ramped up gradually over a range of drill string rpms of about 85. Similarly, as shown in FIG. 17B, the pressure of the torque generator 220 can be reduced gradually over a range of drill string rpms of about 85.

Figure 18A:
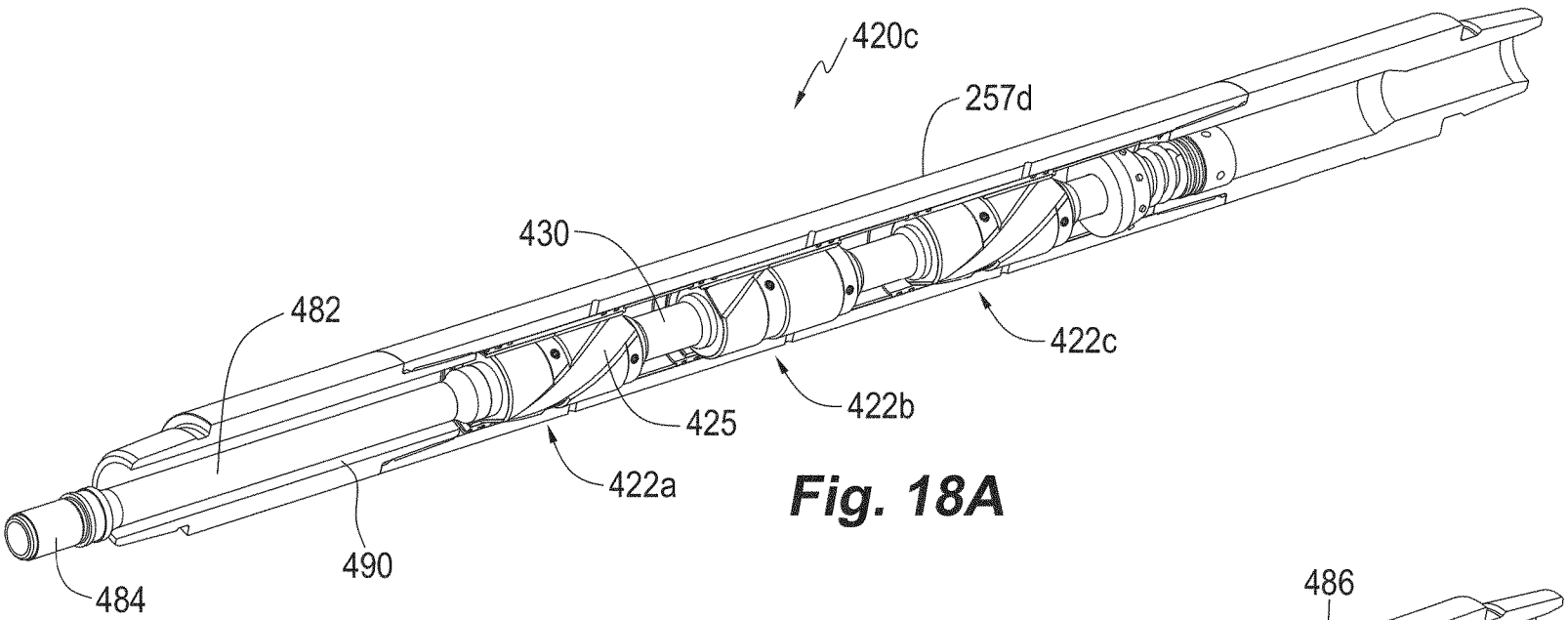
FIGS. 18A and 18B, are a side perspective view and a side cross-section view of one embodiment of an alternative lower portion usable in the torque generator shown in FIGS. 11A and 11B. More particularly.
Figure 18B:
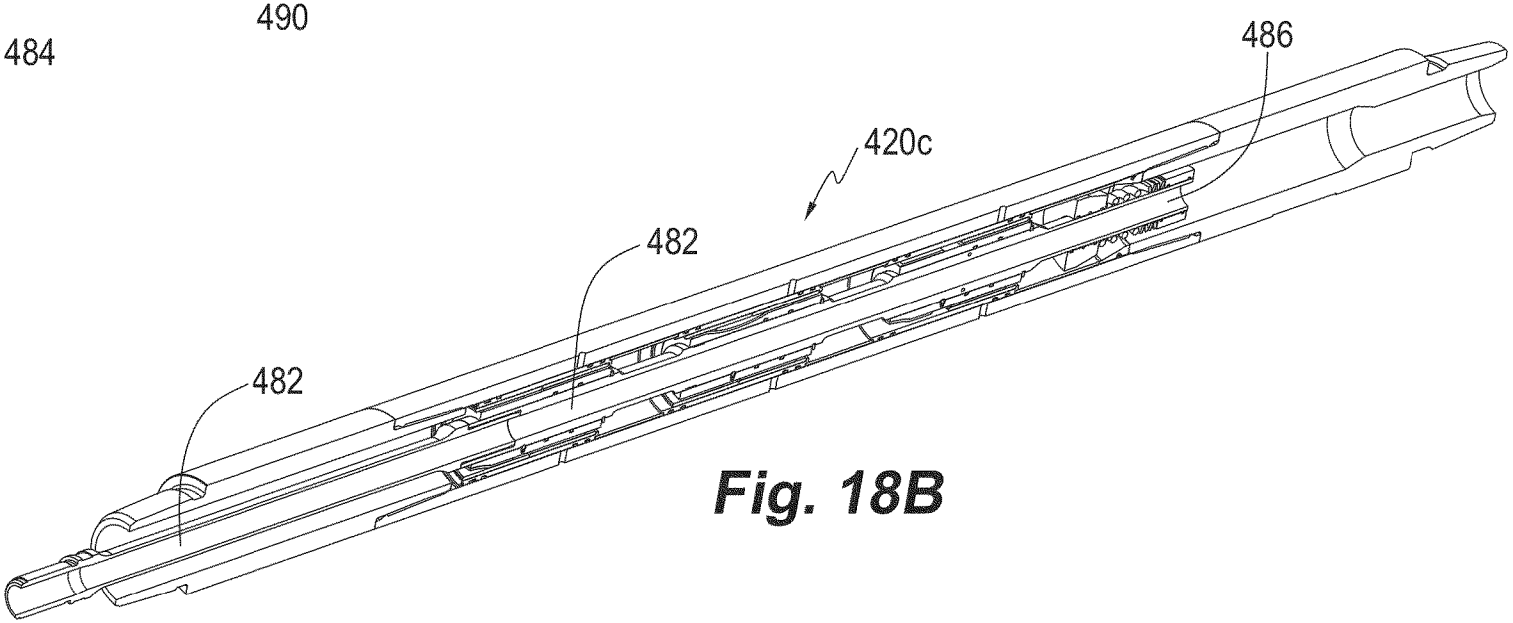

FIGS. 18A and 18B show another alternative tool face controller or lower portion 420*c* that can be used in the torque generator 220 instead of the lower portions 220*c* and 320*c*, previously described. The lower portion 420*c* is configured to allow the selective fine tuning of the rpm of the face of the drill bit (i.e., the tool face), while eliminating the bearings and/or rotating seals in previously described embodiments. In other words, the inclusion of alternative lower portion 420*c* in the torque generator also allows high resolution tool face control over a larger (and tunable) range of drill string rpm set points to help to maximize the tool's performance, while maintaining an optimal resolution for tool face control.

Figure 18C:
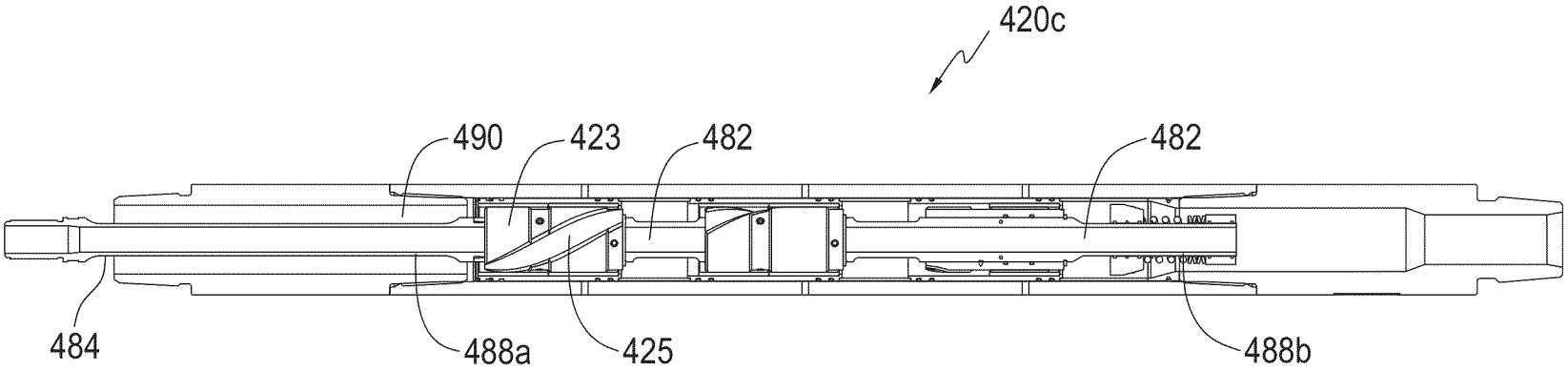
FIG. 18C is a cross-sectional view of the alternative lower portion of FIG. 18A.

In one embodiment, with reference to FIGS. 18A, 18B, and 18C, the second tubular housing 257*d* of the torque generator housing forms the outer tubular of the lower portion 420*c*. Similar to other lower portions 220*c* and 320*c*, the downhole end of the second tubular housing 257*d* is configured to be coupled downhole to the bent sub and drilling motor per that disclosed in the '839 Patent. The lower portion 420*c* comprises an extension tubular conduit 484 having an axially extending inner bore 482; an upper end for connection with the downhole end of the rotor 254; and a lower discharge end 486. When conduit 484 is connected to the rotor 254, inner bore 482 is in fluid communication with the central bore 282 of the rotor and at least a portion of the conduit 484 is rotatable with the rotor 254 and drill string 14. The conduit 484 extends substantially axially through the inner bore of the second tubular housing 257*d*, thereby defining an annulus 490 therebetween. In some embodiments, conduit 484 comprises an upper conduit portion 488*a* that is rotatable with the rotor 254 and drill string 14, and a lower conduit portion 488*b* which may be rotatable with the torque generator housing 258.

In some embodiments, the lower portion 420*c* may comprise a shaft 430 for supporting one or more fluid flow restrictions, as will be described. It should be understood that the shaft may be a separate tubular received within annulus 490 and having an upper end 430*a* operably connected with conduit 484, and thus directly rotatable with rotor 254, or shaft 430 may be integral to and form part of the extension conduit 484.

According to embodiments, shaft 430 may serve to support or provide one or more fluid restrictions positioned within the annulus 490 for creating a reduction in static fluid pressure of the torque generator fluid stream 62 flowing therethrough. Such flow restrictions are shown in the illustrated embodiments as a plurality helical shaft assemblies forming helical fluid flow pathways 425 about their outer surfaces, although it should be understood that such flow restrictions may be any size, shape, and/or configuration (e.g. flow channels need not be helical in design). In some embodiments, the fluid flow pathway 425 may comprise an offset fluid flow pathway, wherein the pathway between the one or more fluid flow restrictions is axially offset from one restriction in relation to the next (as will be described). As above, it is contemplated that the one or more fluid flow restrictions serve to create a cascading reduction in fluid pressure of the tool face controller 420*c* and help to reduce the sensitivity of the tool face in response to changes in the drill string speed (rpm), as described above. It should be understood that where desired, shaft 430 may be received eccentrically or concentrically within annulus 490.

As shown in FIGS. 18A, 18B and 18C, lower portion 420*c* may comprise a first extension conduit shaft portion 422*a* having a first fluid flow path shaft assembly disposed thereabout, a second shaft portion 422*b* having a second fluid flow path shaft assembly disposed thereabout, and a third shaft portion 422*c* having a third fluid flow path shaft assembly disposed thereabout, the first, second and third shaft portions 422*a*, 422*b*, 422*c* positioned (spaced) axially along shaft 430 in series. Each shaft portion 422*a*, 422*b*, 422*c*, may be situated in the annulus 490 and is integral to and/or supported on the lower conduit portion 488*b*. While the illustrated embodiment shows three offset helical shaft assemblies, the lower portion 420*c* may have fewer or more fluid flow shaft assemblies. Moreover, while the illustrated embodiment shows the one or more fluid flow restrictors being formed by an offset helical channel configuration, serving to improve contact surfaces and mitigate packing off, other fluid flow restriction configurations are contemplated (e.g. one or more annular gaps or flow-restricting apertures, a non-helical fluid flow pathway, etc.).

Each offset helical shaft assembly 422*a*, 422*b*, 422*c* may comprise substantially identical components, so only a first helical assembly 422*a* is described in detail, with the description applying to a plurality of similar portions forming the assembly. First helical assembly 422*a* may comprise a tubular element having an internal bore for receiving the shaft 430 and/or extension tubular conduit 484 extending therethrough, and outer sidewall 423 facing annulus 490. Outer sidewall 423 may form at least one helical fluid flow channel 425 for restricting the torque generator fluid flow 62 flowing through annulus 490, and directing the restricted fluid flowing from above (uphole) of the shaft portion 422*a* to a larger annular space or therebelow (i.e. an annular gap between helical assemblies 422*a* and 422*b*).

In some embodiments, as the torque generator fluid 62 flows through the alternative lower portion 420*c*, fluid 62 encounters the first constricted flow path 425 created by the helical fluid flow channel of the first helical assembly 422*a*, and an area of increased fluid pressure is created immediately above the helical assembly 422*a*. Upon exiting the first helical assembly 422*a*, the torque generator flow 62 continues downstream into the space created below helical assembly 422*a* and above helical assembly 422*b*.

Helical fluid flow channels 425 of each shaft portion 422*a*, 422*b*, 422*c* may be radially offset one from the other (when looking downhole) such that no two channels 425 flow directly one into the other. As previously described, when the torque generator flow 62 encounters the first helical assembly 422*a* (i.e. the first flow restriction), an area of increased fluid pressure is created immediately above the helical assembly 422*a* as the torque generator fluid 62 flows therethrough because the flow path is constricted by the helical fluid flow channel 425. As would be understood by a person skilled in the art, the fluid flow restriction may be predetermined and controllably optimized by the number of helical assemblies 422, by the length of each assembly 422, by the depth and configuration of the fluid flow channel 425, or any combination thereof.

Figure 19A:
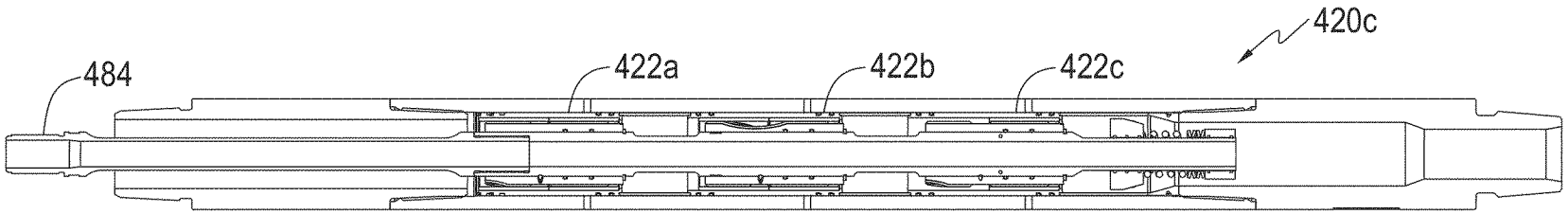
FIGS. 19A, 19B, and 19C, are side cross-sectional views of a the alternative lower portion of FIG. 18A.
Figure 19B:
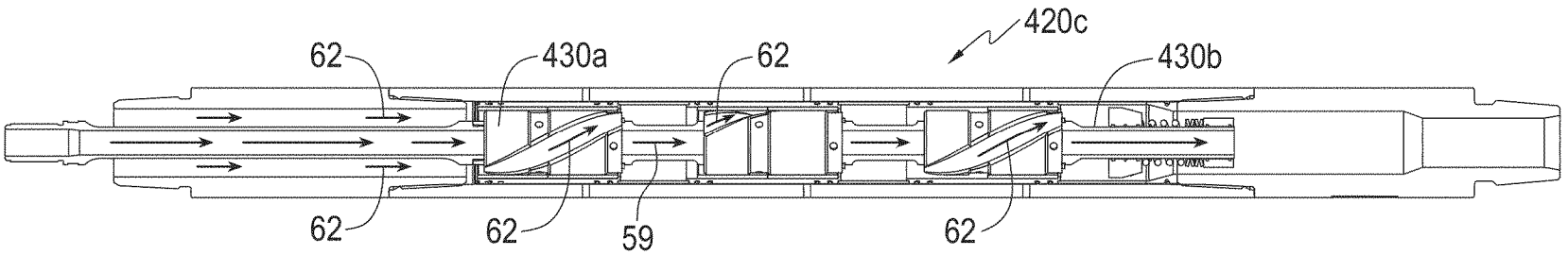
Figure 19C:
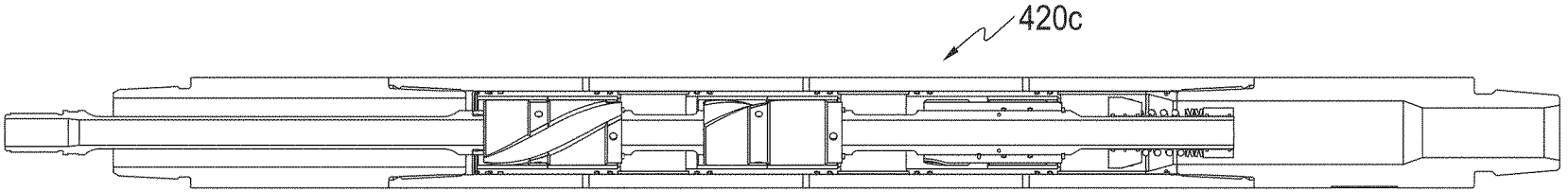

In operation, with reference to FIGS. 19A, 19B, and 19C, lower portion 420*c* is connected to the middle portion 220*b* of the torque generator such that the upper end of extension tubular 484 is attached to the rotor 254 for receiving bypass flow 59 from rotor bore 282, and such that the annulus 490 receives the torque generator flow 62 from the pump. When fluid enters the torque generator as described, the bypass flow 59 flows through inner bore 482 and out of the extension tubular 484 via the discharge end 486. Further, as the rotor 254 rotates, the torque generator flow 62 is pumped from the pump chamber 280 into annular 490 of the lower portion 420*c*.

As would be understood, alternative lower portion 420*c* of the torque generator may further comprise a piston and spring configuration, such that the previously described dynamic torque curve may continue to be generated with the pressure-activated piston. A similar effect for high end torque can thus be achieved. As would be further understood, eccentric shaft portions 422*a*, 422*b*, 422*c* may eliminate the requirement for rotating seals and/or bearings, as described in alternative lower portion 320*c*.

Herein, as would be appreciated by those skilled in the art, the present embodiments may be modified, amended, or configured without departing from the scope of the invention. For example, although componentry such as a positive displacement drilling motor, turbine motor, or a pump are described herein, a person skilled in the art would know and understand that alternative componentry and/or means for dictating fluid flow, such as via electric actuation, are contemplated.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. An apparatus usable with a torque generator connected to a drill string for drilling subterranean bore segments, the torque generator having a housing independently rotatable from an inner pump and the drill string, the rotor forming a rotor bore extending therethrough for the passage of a bypass fluid stream, the apparatus comprising:

an outer tubular housing rotationally coupled to the torque generator housing, the outer tubular housing forming an inner housing bore, an extension conduit extending through the inner housing bore and forming a first annulus therebetween, and one or more piston assemblies positioned in the inner bore, each respective piston assembly having a piston housing fixedly attached to the outer tubular housing, a piston concentrically received within and extending through the piston housing and forming a piston annulus therebetween, the piston annulus in fluid communication with the first annulus for receiving a torque generator fluid stream, the piston slidably movable axially within the piston housing relative to the outer tubular housing and the extension conduit, a spring assembly having a spring sleeve positioned in the annulus and movable axially relative to the outer tubular housing and the extension conduit, at least one spring disposed about the spring sleeve, the at least one spring in abutment with one end of the piston, and a shoulder for restricting the axial movement of the spring sleeve.

2. The apparatus of claim 1, wherein at least a portion of the extension conduit extends through a bearing housing positioned within the inner bore of the housing, the bearing housing containing a plurality of bearings allowing for the outer tubular housing to rotate independently from the extension conduit.

3. The apparatus of claim 1, wherein at least a portion of the piston annulus has a smaller cross-sectional area than the remaining piston annulus, the smaller cross-sectional area forming at least one first fluid restriction.

4. The apparatus of claim 1, wherein the cross-sectional area of the piston annulus varies depending upon the axial position of the piston within the piston housing.

5. The apparatus of claim 1, wherein the spring assembly comprises at least two springs.

6. The apparatus of claim 5, wherein the at least two springs are sealingly separated by a divider.

7. The apparatus of claim 1, wherein the apparatus may further comprise a fluid flow distributor positioned in the inner housing bore, the flow distributor forming a plurality of apertures for constricting the bypass fluid stream flowing through the annulus.

8. The apparatus of claim 7, wherein the fluid flow distributor may be positioned above the one or more piston assemblies.

9. The apparatus of claim 1, wherein, at its downhole end, the apparatus is operably coupled to a bent sub and drilling motor.

10. A method of controlling tool face using a torque generator operably coupled to a drill string for drilling subterranean bore segments, the torque generator having a housing independently rotatable from an inner pump and the drill string, and having a tubular extension conduit received within the housing and forming an annulus therebetween, the method comprising:

pumping fluids into the torque generator, a first portion of the fluids passing through the torque generator as a bypass fluid flow, providing at least one fluid flow distributor for directing a second portion of the fluids into the annulus as a torque generator fluid stream, providing at least one fluid flow restriction in the annulus for increasing fluid pressure of the torque generator fluid flow above the restriction, creating a reduction in fluid pressure of the torque generator fluid stream.

11. The method of claim 10, wherein the at least one fluid flow restriction positioned in the annulus comprises at least one piston assembly forming a restricted fluid flow pathway.

12. The method of claim 11, wherein the at least one piston assembly forms at least two fluid flow restrictions.

13. The method of claim 11, wherein the at least piston assemblies create a cascading reduction in pressure of the torque generator fluid stream to dynamically reduce tool face sensitivity in response to the changes in the drill string speed (rpm).

* * * * *